US006950111B2

(12) United States Patent
Kagawa et al.

(10) Patent No.: US 6,950,111 B2
(45) Date of Patent: Sep. 27, 2005

(54) IMAGE DISPLAY UNIT

(75) Inventors: Shuichi Kagawa, Tokyo (JP); Hiroaki Sugiura, Tokyo (JP); Mariko Takahashi, Tokyo (JP); Narihiro Matoba, Tokyo (JP); Kohei Teramoto, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 383 days.

(21) Appl. No.: 10/203,315

(22) PCT Filed: Dec. 11, 2000

(86) PCT No.: PCT/JP00/08755

§ 371 (c)(1),
(2), (4) Date: Aug. 9, 2002

(87) PCT Pub. No.: WO02/48996

PCT Pub. Date: Jun. 20, 2002

(65) Prior Publication Data

US 2003/0052868 A1 Mar. 20, 2003

(51) Int. Cl.[7] ..... G09G 5/02
(52) U.S. Cl. ..... 345/591
(58) Field of Search ..... 345/589, 591, 345/593, 600–602, 617

(56) References Cited

FOREIGN PATENT DOCUMENTS

JP 04057072 A * 2/1992 ..... G03G/15/01
JP 404057072 A * 2/1992 ..... G03G/15/01
JP 6-160845 A 6/1994
JP 410145595 A * 5/1998 ..... H04N/1/407

* cited by examiner

*Primary Examiner*—Matthew C. Bella
*Assistant Examiner*—G. F. Cunningham
(74) *Attorney, Agent, or Firm*—Birch, Stewart, Kolasch & Birch, LLP

(57) ABSTRACT

The invention relates to an image display device displaying color image and has its object to display image having a large contrast and excellent visibility to the viewer in an image display device particularly used under environment where external light exists.

To achieve the above object, black-approximated data generating means 4 generates black-approximated data R3, G3, and B3 that are data related to chromaticity in displaying black on image display means 3. Black correction means 2A subtracts subtraction data R4, G4, and B4 that have the same value as the black-approximated data R3, G3, and B3, from after-input-processing image data R1, G1, and B1, thereby to calculate after-black-correction image data R2, G2, and B2. The image display means 3 emits in response to the values of the after-black-correction image data R2, G2, and B2, thereby to perform image display processing on a predetermined screen.

15 Claims, 33 Drawing Sheets

FIG. 3

| R1 | G1 | B1 | R2 | G2 | B2 | X3 | Y3 | Z3 | RATIO TO WHITE (Y/Ymax) |
|---|---|---|---|---|---|---|---|---|---|
| 0 | 0 | 0 | 0 | 0 | 0 | 10.505 | 11.000 | 11.890 | 0.109 |
| 10 | 10 | 10 | 0 | 0 | 0 | 10.505 | 11.000 | 11.890 | 0.109 |
| 20 | 20 | 20 | 10 | 10 | 10 | 20.010 | 21.000 | 22.780 | 0.208 |
| 30 | 30 | 30 | 20 | 20 | 20 | 29.515 | 31.000 | 33.670 | 0.307 |
| 40 | 40 | 40 | 30 | 30 | 30 | 39.020 | 41.000 | 44.560 | 0.406 |
| 50 | 50 | 50 | 40 | 40 | 40 | 48.525 | 51.000 | 55.450 | 0.505 |
| 60 | 60 | 60 | 50 | 50 | 50 | 58.030 | 61.000 | 66.340 | 0.604 |
| 70 | 70 | 70 | 60 | 60 | 60 | 67.535 | 71.000 | 77.230 | 0.703 |
| 80 | 80 | 80 | 70 | 70 | 70 | 77.040 | 81.000 | 88.120 | 0.802 |
| 90 | 90 | 90 | 80 | 80 | 80 | 86.545 | 91.000 | 99.010 | 0.901 |
| 100 | 100 | 100 | 90 | 90 | 90 | 96.050 | 101.000 | 109.900 | 1.000 |

FIG. 4

| R1 | G1 | B1 | X3 | Y3 | Z3 | RATIO TO WHITE (Y/Ymax) |
|---|---|---|---|---|---|---|
| 0 | 0 | 0 | 1.000 | 1.000 | 1.000 | 0.010 |
| 10 | 10 | 10 | 10.505 | 11.000 | 11.890 | 0.109 |
| 20 | 20 | 20 | 20.010 | 21.000 | 22.780 | 0.208 |
| 30 | 30 | 30 | 29.515 | 31.000 | 33.670 | 0.307 |
| 40 | 40 | 40 | 39.020 | 41.000 | 44.560 | 0.406 |
| 50 | 50 | 50 | 48.525 | 51.000 | 55.450 | 0.505 |
| 60 | 60 | 60 | 58.030 | 61.000 | 66.340 | 0.604 |
| 70 | 70 | 70 | 67.535 | 71.000 | 77.230 | 0.703 |
| 80 | 80 | 80 | 77.040 | 81.000 | 88.120 | 0.802 |
| 90 | 90 | 90 | 86.545 | 91.000 | 99.010 | 0.901 |
| 100 | 100 | 100 | 96.050 | 101.000 | 109.900 | 1.000 |

FIG. 7

| R1 | G1 | B1 | R2 | G2 | B2 | X3 | Y3 | Z3 | RATIO TO WHITE (Y/Ymax) |
|---|---|---|---|---|---|---|---|---|---|
| 0 | 0 | 0 | 0 | 0 | 0 | 19.505 | 20.000 | 20.890 | 0.200 |
| 10 | 10 | 10 | 0 | 0 | 0 | 19.505 | 20.000 | 20.890 | 0.200 |
| 20 | 20 | 20 | 0 | 1 | 1 | 19.855 | 20.435 | 21.820 | 0.204 |
| 30 | 30 | 30 | 8 | 11 | 11 | 28.515 | 30.000 | 32.670 | 0.300 |
| 40 | 40 | 40 | 18 | 21 | 21 | 38.020 | 40.000 | 43.560 | 0.400 |
| 50 | 50 | 50 | 28 | 31 | 31 | 47.525 | 50.000 | 54.450 | 0.500 |
| 60 | 60 | 60 | 38 | 41 | 41 | 57.030 | 60.000 | 65.340 | 0.600 |
| 70 | 70 | 70 | 48 | 51 | 51 | 66.535 | 70.000 | 76.230 | 0.700 |
| 80 | 80 | 80 | 58 | 61 | 61 | 76.040 | 80.000 | 87.120 | 0.800 |
| 90 | 90 | 90 | 68 | 71 | 71 | 85.545 | 90.000 | 98.010 | 0.900 |
| 100 | 100 | 100 | 78 | 81 | 81 | 95.050 | 100.000 | 108.900 | 1.000 |

| R1 | G1 | B1 | X3 | Y3 | Z3 | RATIO TO WHITE (Y/Ymax) |
|---|---|---|---|---|---|---|
| 0 | 0 | 0 | 19.505 | 20.000 | 20.890 | 0.167 |
| 10 | 10 | 10 | 29.010 | 30.000 | 31.780 | 0.250 |
| 20 | 20 | 20 | 38.515 | 40.000 | 42.670 | 0.333 |
| 30 | 30 | 30 | 48.020 | 50.000 | 53.560 | 0.417 |
| 40 | 40 | 40 | 57.525 | 60.000 | 64.450 | 0.500 |
| 50 | 50 | 50 | 67.030 | 70.000 | 75.340 | 0.583 |
| 60 | 60 | 60 | 76.535 | 80.000 | 86.230 | 0.667 |
| 70 | 70 | 70 | 86.040 | 90.000 | 97.120 | 0.750 |
| 80 | 80 | 80 | 95.545 | 100.000 | 108.010 | 0.833 |
| 90 | 90 | 90 | 105.050 | 110.000 | 118.900 | 0.917 |
| 100 | 100 | 100 | 114.555 | 120.000 | 129.790 | 1.000 |

FIG. 8

FIG. 9

| R1 | G1 | B1 | X3 | Y3 | Z3 | RATIO TO WHITE (Y/Ymax) |
|---|---|---|---|---|---|---|
| 0 | 0 | 0 | 0.000 | 0.000 | 0.000 | 0.200 |
| 10 | 10 | 10 | 9.505 | 10.000 | 10.890 | 0.200 |
| 20 | 20 | 20 | 19.010 | 20.000 | 21.780 | 0.204 |
| 30 | 30 | 30 | 28.515 | 30.000 | 32.670 | 0.300 |
| 40 | 40 | 40 | 38.020 | 40.000 | 43.560 | 0.400 |
| 50 | 50 | 50 | 47.525 | 50.000 | 54.450 | 0.500 |
| 60 | 60 | 60 | 57.030 | 60.000 | 65.340 | 0.600 |
| 70 | 70 | 70 | 66.535 | 70.000 | 76.230 | 0.700 |
| 80 | 80 | 80 | 76.040 | 80.000 | 87.120 | 0.800 |
| 90 | 90 | 90 | 85.545 | 90.000 | 98.010 | 0.900 |
| 100 | 100 | 100 | 95.050 | 100.000 | 108.900 | 1.000 |

——— IMAGE DISPLAY DEVICE OF SECOND PREFERRED EMBODIMENT (THERE IS EXTERNAL LIGHT, Xbk1 = Ybk1 = Zbk1 = 10)

-------- WHEN THERE IS NO INFLUENCE OF EXTERNAL LIGHT, Xbk1 = Ybk1 = Zbk1 = 0の場合

—·—·— CONVENTIONAL IMAGE DISPLAY DEVICE (THERE IS EXTERNAL LIGHT, AND Xbk1 = Ybk1 = Zbk1 = 10)

FIG. 13

| R1 | G1 | B1 | R5 | G5 | B5 | R2 | G2 | B2 | X3 | Y3 | Z3 | RATIO TO WHITE (Y/Ymax) |
|---|---|---|---|---|---|---|---|---|---|---|---|---|
| 0 | 0 | 0 | −10 | −10 | −10 | 0 | 0 | 0 | 10.505 | 11.000 | 11.890 | 0.109 |
| 10 | 10 | 10 | 0 | 0 | 0 | 5 | 5 | 5 | 15.258 | 16.000 | 17.335 | 0.158 |
| 20 | 20 | 20 | 10 | 10 | 10 | 10 | 10 | 10 | 20.010 | 21.000 | 22.780 | 0.208 |
| 30 | 30 | 30 | 20 | 20 | 20 | 20 | 20 | 20 | 29.515 | 31.000 | 33.670 | 0.307 |
| 40 | 40 | 40 | 30 | 30 | 30 | 30 | 30 | 30 | 39.020 | 41.000 | 44.560 | 0.406 |
| 50 | 50 | 50 | 40 | 40 | 40 | 40 | 40 | 40 | 48.525 | 51.000 | 55.450 | 0.505 |
| 60 | 60 | 60 | 50 | 50 | 50 | 50 | 50 | 50 | 58.030 | 61.000 | 66.340 | 0.604 |
| 70 | 70 | 70 | 60 | 60 | 60 | 60 | 60 | 60 | 67.535 | 71.000 | 77.230 | 0.703 |
| 80 | 80 | 80 | 70 | 70 | 70 | 70 | 70 | 70 | 77.040 | 81.000 | 88.120 | 0.802 |
| 90 | 90 | 90 | 80 | 80 | 80 | 80 | 80 | 80 | 86.545 | 91.000 | 99.010 | 0.901 |
| 100 | 100 | 100 | 90 | 90 | 90 | 90 | 90 | 90 | 96.050 | 101.000 | 109.900 | 1.000 |

——— IMAGE DISPLAY DEVICE OF THIRD PREFERRED EMBODIMENT (THERE IS EXTERNAL LIGHT)

- - - - - - - WHEN THERE IS NO INFLUENCE OF EXTERNAL LIGHT

—·—·— CONVENTIONAL IMAGE DISPLAY DEVICE (THERE IS EXTERNAL LIGHT)

FIG. 18

| R1 | G1 | B1 | R2 | G2 | B2 | X3 | Y3 | Z3 | RATIO TO WHITE (Y/Ymax) |
|---|---|---|---|---|---|---|---|---|---|
| 0 | 0 | 0 | 0 | 0 | 0 | 10.505 | 11.000 | 11.890 | 0.109 |
| 10 | 10 | 10 | 5 | 5 | 5 | 15.258 | 16.000 | 17.335 | 0.158 |
| 20 | 20 | 20 | 10 | 10 | 10 | 20.010 | 21.000 | 22.780 | 0.208 |
| 30 | 30 | 30 | 20 | 20 | 20 | 29.515 | 31.000 | 33.670 | 0.307 |
| 40 | 40 | 40 | 30 | 30 | 30 | 39.020 | 41.000 | 44.560 | 0.406 |
| 50 | 50 | 50 | 40 | 40 | 40 | 48.525 | 51.000 | 55.450 | 0.505 |
| 60 | 60 | 60 | 50 | 50 | 50 | 58.030 | 61.000 | 66.340 | 0.604 |
| 70 | 70 | 70 | 60 | 60 | 60 | 67.535 | 71.000 | 77.230 | 0.703 |
| 80 | 80 | 80 | 70 | 70 | 70 | 77.040 | 81.000 | 88.120 | 0.802 |
| 90 | 90 | 90 | 80 | 80 | 80 | 86.545 | 91.000 | 99.010 | 0.901 |
| 100 | 100 | 100 | 90 | 90 | 90 | 96.050 | 101.000 | 109.900 | 1.000 |

IMAGE DISPLAY DEVICE OF FOURTH PREFERRED EMBODIMENT (THERE IS EXTERNAL LIGHT)

WHEN THERE IS NO INFLUENCE OF EXTERNAL LIGHT

CONVENTIONAL IMAGE DISPLAY DEVICE (THERE IS EXTERNAL LIGHT)

FIG. 31

| R1 | G1 | B1 | X3 | Y3 | Z3 | RATIO TO WHITE (Y/Ymax) |
|---|---|---|---|---|---|---|
| 0 | 0 | 0 | 1.000 | 1.000 | 1.000 | 0.010 |
| 10 | 10 | 10 | 10.505 | 11.000 | 11.890 | 0.109 |
| 20 | 20 | 20 | 20.010 | 21.000 | 22.780 | 0.208 |
| 30 | 30 | 30 | 29.515 | 31.000 | 33.670 | 0.307 |
| 40 | 40 | 40 | 39.020 | 41.000 | 44.560 | 0.406 |
| 50 | 50 | 50 | 48.525 | 51.000 | 55.450 | 0.505 |
| 60 | 60 | 60 | 58.030 | 61.000 | 66.340 | 0.604 |
| 70 | 70 | 70 | 67.535 | 71.000 | 77.230 | 0.703 |
| 80 | 80 | 80 | 77.040 | 81.000 | 88.120 | 0.802 |
| 90 | 90 | 90 | 86.545 | 91.000 | 99.010 | 0.901 |
| 100 | 100 | 100 | 96.050 | 101.000 | 109.900 | 1.000 |

FIG. 33

| R1 | G1 | B1 | X3 | Y3 | Z3 | RATIO TO WHITE (Y/Ymax) |
|---|---|---|---|---|---|---|
| 0 | 0 | 0 | 10.505 | 11.000 | 11.890 | 0.099 |
| 10 | 10 | 10 | 20.010 | 21.000 | 22.780 | 0.189 |
| 20 | 20 | 20 | 29.515 | 31.000 | 33.670 | 0.279 |
| 30 | 30 | 30 | 39.020 | 41.000 | 44.560 | 0.369 |
| 40 | 40 | 40 | 48.525 | 51.000 | 55.450 | 0.459 |
| 50 | 50 | 50 | 58.030 | 61.000 | 66.340 | 0.550 |
| 60 | 60 | 60 | 67.535 | 71.000 | 77.230 | 0.640 |
| 70 | 70 | 70 | 77.040 | 81.000 | 88.120 | 0.730 |
| 80 | 80 | 80 | 86.545 | 91.000 | 99.010 | 0.820 |
| 90 | 90 | 90 | 96.050 | 101.000 | 109.900 | 0.910 |
| 100 | 100 | 100 | 105.555 | 111.000 | 120.790 | 1.000 |

FIG. 35

| R1 | G1 | B1 | X3 | Y3 | Z3 | RATIO TO WHITE (Y/Ymax) |
|---|---|---|---|---|---|---|
| 0 | 0 | 0 | 11.505 | 12.000 | 12.890 | 0.057 |
| 10 | 10 | 10 | 30.515 | 32.000 | 34.670 | 0.151 |
| 20 | 20 | 20 | 49.525 | 52.000 | 56.450 | 0.245 |
| 30 | 30 | 30 | 68.535 | 72.000 | 78.230 | 0.340 |
| 40 | 40 | 40 | 87.545 | 92.000 | 100.010 | 0.434 |
| 50 | 50 | 50 | 106.555 | 112.000 | 121.790 | 0.528 |
| 60 | 60 | 60 | 125.565 | 132.000 | 143.570 | 0.623 |
| 70 | 70 | 70 | 144.575 | 152.000 | 165.350 | 0.717 |
| 80 | 80 | 80 | 163.585 | 172.000 | 187.130 | 0.811 |
| 90 | 90 | 90 | 182.595 | 192.000 | 208.910 | 0.906 |
| 100 | 100 | 100 | 201.605 | 212.000 | 230.690 | 1.000 |

IMAGE DISPLAY UNIT

This application is the national phase under 35 U.S.C. §371 of PCT International Application No. PCT/JP00/08755 which has an International filing date of Dec. 11, 2000, which designated the United States of America.

TECHNICAL FIELD

The present invention relates to an image display device displaying color image, such as monitors and projectors, and in particular, to an image display device used under environment where external light exists, as well as an image display device that has a large value of luminance when displaying black because of its characteristics.

BACKGROUND ART

FIG. 29 is a block diagram showing an example of configurations of conventional image display devices. The operation of a conventional image display device will be described below with reference to FIG. 29. This image display device is configured with an input image processing means 1 and an image display means 3, as shown in FIG. 29.

Referring to FIG. 29, image data Ri, Gi, and Bi that are composed of three color (RGB) data to be inputted to the image display device are inputted to the input image processing means 1. The inputted image data Ri, Gi, and Bi are subjected to input image processing, which will be described hereinafter in connection with the input image processing means 1, and then outputted as image data R1, G1, and B1 composed of three color data. The image data R1, G1, and B1 outputted from the input image processing means 1 are sent to the image display means 3. In the image display means 3, in response to the corresponding image data value, each pixel emits a light for image display. As an example of the image display means, there is a liquid crystal panel or CRT.

FIG. 30 is a block diagram showing an example of the configuration of the input image processing means 1 in FIG. 29. Referring to FIG. 30, the input image processing means 1 is configured with a pixel number transforming means 101, color transforming means 102, and gradation transforming means 103.

The operation of the input image processing means 1 will be described hereinafter. Image data Ri, Gi, and Bi inputted to the input image processing means 1 are inputted to the pixel number transforming means 101 and subjected to pixel number transformation so as to match the display pixel number in the image display means 3, and then outputted.

The output from the pixel number transforming means 101 is inputted to the color transforming means 102 and subjected to color transformation processing in consideration of the color reproduction characteristics of the image display means 3. Performing this color transformation processing realizes display of a desirable color reproduction in the image display means 3.

The output from the color transforming means 102 is inputted to the gradation transforming means 103 and subjected to gradation correction processing in response to the characteristics of the image display means 3, and then outputted as image data R1, G1, and B1. The pixel number transforming means 101, color transforming means 102, and gradation transforming means 103 may be configured with hardware or software.

Description will now be given of the relationship between the size of the image data R1, G1, and B1 inputted to the image display means 3, and the color (light) displayed on the image display means 3. Let X1, Y1, and Z1 denote tristimulus values based on the CIE XYZ calorimetric system of color (light) displayed on the image display means 3, when image data R1, G1, and B1 are inputted to the image display means 3 in a situation where there is no influence of external light (hereinafter referred to simply as "tristimulus values"). Assume that the image display means 3 is an image display means in which the relationship between the size of image data R1, G1, and B1 to be inputted and the tristimulus values X1, Y1, and Z1 of color (light) to be displayed can be expressed in the following equation (1):

$$\begin{bmatrix} X1 \\ Y1 \\ Z1 \end{bmatrix} = \begin{bmatrix} axr & axg & axb \\ ayr & ayg & ayb \\ azr & azg & azb \end{bmatrix} \begin{bmatrix} R1 \\ G1 \\ B1 \end{bmatrix} + \begin{bmatrix} Xbk1 \\ Ybk1 \\ Zbk1 \end{bmatrix} \tag{1}$$

where Y1 is a value corresponding to a luminance.

In equation (1), axr, ayr, azr, axg, ayg, azg, axb, ayb, azb; and Xbk1, Ybk1, Zbk1, are values that depend on the characteristics of the image display means 3. In particular, Xbk1, Ybk1, and Zbk1 are tristimulus values of color (light) displayed on the image display means 3 when the image display means 3 displays black in a situation where there is no influence of external light, that is, when R1=G1=B1=0. Here, axr, ayr, azr, axg, ayg, azg, axb, ayb, and azb can be expressed in the following equation (2):

$$axr=0.4124,\ axg=0.3576,\ axb=0.1805,\ ayr=0.2126,\ ayg=0.7152,\ ayb=0.0722,\ azr=0.0193,\ azg=0.1192,\ azb=0.9505 \tag{2}$$

Image data R1, G1, and B1 to be inputted to the image display means 3 are integers and have values in the range expressed in the following equation (3):

$$0 \leqq R1 \leqq 100 \quad 0 \leqq G1 \leqq 100 \quad 0 \leqq B1 \leqq 100 \tag{3}$$

Theoretically, all tristimulus values in displaying black, Xbk1, Ybk1, and Zbk1, should be "0", however, they have in fact values larger than "0". Further, let X2, Y2, and Z2 denote tristimulus values of a reflected light caused by that external light irradiates the surface of the image display means 3 and the external light is reflected from the surface of the image display means 3. In this case, tristimulus values X3, Y3, and Z3 of light received by the eyes of a viewer who views the image display means 3 can be expressed by the sum of the tristimulus values X1, Y1, and Z1 of color to be displayed on the image display means 3 by input signals R1, G1, and B1, and the tristimulus values X2, Y2, and Z2 of the reflected light. That is, X3, Y3, and Z3 can be expressed in the following equation (4). The viewer seems as if the color expressed by X3, Y3, and Z3 were displayed on the image display means 3.

$$\begin{bmatrix} X3 \\ Y3 \\ Z3 \end{bmatrix} = \begin{bmatrix} X1 \\ Y1 \\ Z1 \end{bmatrix} + \begin{bmatrix} X2 \\ Y2 \\ Z2 \end{bmatrix} = \begin{bmatrix} axr & axg & axb \\ ayr & ayg & ayb \\ azr & azg & azb \end{bmatrix} \begin{bmatrix} R1 \\ G1 \\ B1 \end{bmatrix} + \begin{bmatrix} Xbk1 + X2 \\ Ybk1 + Y2 \\ Zbk1 + Z2 \end{bmatrix} \tag{4}$$

From equation (4), Xbk1+X2, Ybk1+Y2, and Zbk1+Z2 are tristimulus values when displaying black on the image display means 3, taking the influence of external light into consideration. From equation (4), the variations in value of the tristimulus values Xbk1, Ybk1, and Zbk1 when displaying black in a situation where there is no influence of external light, and the variations in value of the tristimulus values X2, Y2, and Z2 of the reflected light of external light, exert the same influence on the tristimulus values X3, Y3, and Z3 of light received by the viewer's eyes. Therefore, the following is the instance that the values of Xbk1, Ybk1, and Zbk1 are fixed and the values of X2, Y2, and Z2 vary due to the influence of external light. The same concept is applicable to the instance that the values of Xbk1, Ybk1, and Zbk1 vary. Here, let Xbk1, Ybk1, and Zbk1 be values expressed in the following equation (5):

$$Xbk1=1Ybk1=1Zbk1=1 \quad (5)$$

FIG. 31 is an explanatory diagram showing in table the relationship between R1, G1, and B1 inputted to the image display means 3 and tristimulus values X3, Y3, and Z3 of color (light) received by the viewer's eyes in a situation where there is no influence of external light, i.e., when X2=Y2=Z2=0. Specifically, FIG. 31 shows the instance that the relationship of R1=G1=B1 holds, i.e., an achromatic data is inputted to the image display means 3.

Consider now the instance that there is no influence of external light, by referring to FIG. 31. If there is no influence of external light, X2=Y2=Z2=0. When the maximum values of image data R1, G1, and B1, i.e., 100, 100, and 100, are inputted to the image display means 3, the tristimulus values of color (light) received by the viewer's eyes are X1=96.05, Y1=101, and Z1=109.9, in a situation where there is no influence of external light. On the other hand, when the minimum values of image data R1, G1, and B1, i.e., 0, 0, and 0, are inputted to the image display means 3, the tristimulus values of color (light) received by the viewer's eyes are X1=1, Y1=1, and Z1=1, in a situation where there is no influence of external light.

In FIG. 31, the ratio of Y3 that corresponds to luminance in the tristimulus values of color (light) received by the viewer's eyes when R1, G1, and B1 are inputted to the image display means 3, to Y3 when R1=100, G1=100, and B1=100 (when displaying white), is indicated as a ratio to white (Y/Ymax). The viewer seems that the image displayed on the image display means 3 has a larger contrast and more excellent visibility as the value of ratio to white is smaller to each image data.

FIG. 32 is a graph showing the relationship between image data R1, G1, and B1 inputted to the image display means 3, and a luminance stimulus value Y3.

Description will next be given of image display in an image display means 3 of a conventional image display device when the device is used under environment where there is the influence of external light.

FIG. 33 is an explanatory diagram showing in table the relationship between R1, G1, B1, and the tristimulus values X3, Y3, Z3 of color (light) received by the viewer's eyes in a situation where there is the influence of external light. Specifically, FIG. 33 shows the instance that the relationship of R1=G1=B1 holds, i.e., an achromatic data is inputted to the image display means 3.

Here, suppose that the tristimulus values of a reflected light of external light on the surface of the image display means 3 are X2=9.505, Y2=10, and Z2=10.89. When the maximum values of R1, G1, and B1, namely, 100, 100, and 100, are inputted to the image display means 3, the tristimulus values of color (light) received by the viewer's eyes are X3=105.555, Y3=111.000, and Z3=120.790. On the other hand, when the minimum values of R1, G1, and B1, i.e., 0, 0, and 0, are inputted to the image display means 3, the tristimulus values of color (light) received by the viewer's eyes are X3=10.505, Y3=11.000, and Z3=11.890.

Also in FIG. 33, the ratio of Y3 that corresponds to luminance in the tristimulus values of color (light) received by the viewer's eyes when R1, G1, and B1 are inputted to the image display means 3, to Y3 (Ymax) when R1=100, G1=100, and B1=100 (when displaying white), is indicated as a ratio to white (Y/Ymax). The values obtained when there is the influence of external light are large as a whole than when there is no influence of external light, as shown in FIG. 31. That is, when there is the influence of external light, the viewer seems that the image has a small contrast and poor visibility.

FIG. 34 is a graph showing the relationship between image data R1, G1, and B1 inputted to the image display means 3, and a luminance stimulus value Y3. In FIG. 34, a continuous line represents the instance that there is the influence of external light, and a dotted line represents the instance that there is no influence of external light.

In order to suppress a drop in contrast due to the influence of external light, it can be considered to increase the brightness of display on the image display means 3 in a situation where there is the influence of external light. For instance, doubling the brightness of display on the image display means 3 doubles tristimulus values X1, Y1, and Z1 of color (light) displayed on the image display means 3.

FIG. 35 is an explanatory diagram showing in table the relationship between R1, G1, B1, and the tristimulus values X3, Y3 and Z3 of color (light) received by the viewer's eyes in a situation where the brightness of display on the image display means 3 is double that of the above instance, and there is the influence of external light. Specifically, FIG. 35 shows the instance that the relationship of R1=G1=B1 holds, i.e., an achromatic data is inputted to the image display means 3. Again, suppose that the tristimulus values of a reflected light of external light on the surface of the image display means 3 are X2=9.505, Y2=10, and Z2=10.89, as in the instance of FIG. 33.

Also in FIG. 35, the ratio of Y3 that corresponds to luminance in the tristimulus values of color (light) received by the viewer's eyes when R1, G1, and B1 are inputted to the image display means 3, to Y3 (Ymax) when R1=100, G1=100, and B1=100 (when displaying white), is indicated as a ratio to white (Y/Ymax). As compared to the instance in FIG. 33, doubling the brightness of display on the image display means 3 makes the values of ratio to white approach the ratios to white in FIG. 31 showing the instance that there is no influence of external light. However, the values are still large as compared to FIG. 31. There is also such technical background that it is very difficult to double the brightness of display on the image display means 3, due to problems of cost, problems of power consumption, and problems of useful life.

Thus, the conventional image display device suffers from the problem that when there is the influence of external light or when the luminance in displaying black has a large value due to the characteristics of the image display means, a ratio to white (Y/Ymax), which is a ratio of a luminance displayed for each image data to a luminance in displaying white, is considerably large and the viewer seems that the image has a small contrast and poor visibility.

There is also the problem that a mitigation of the increased ratio to luminance in displaying white by increasing the brightness of display on the image display device results in poor improvement effect, though this is very difficult due to problems of cost, problems of power consumption, and problems of useful life.

DISCLOSURE OF INVENTION

The present invention aims at overcoming the above problem and has its object to obtain an image display device that is capable of displaying image having a large contrast and excellent visibility to the viewer even when there is the influence of external light and when the luminance in displaying black has a large value due to the characteristics of an image display means; and that is free from problems of increasing cost and power consumption and decreasing useful lifetime in the image display means, which are caused by reducing an increase in ratio to luminance when displaying white.

A first aspect of an image display device according to the invention includes: a black correction part performing a black correction processing for correcting black reproducibility on an image data containing a color data to output an after-black-correction image data; and an image display means performing an image display on a predetermined screen based on the after-black-correction image data, the black correction part performing the black correction processing based on characteristics of the image display means when displaying black.

In a second aspect of the image display device according to the invention, the color data contains a predetermined number of color data, and the black correction part includes: a black-approximated data generating means generating a black-approximated data that is data related to at least one of luminance, chromaticity and tristimulus values when the image display means displays black based on the characteristics of the image display means when displaying black; and a black correction means performing subtraction processing on the image data based on the black-approximated data in units of the predetermined number of color data, to output the after-black-correction image data.

In a third aspect of the image display device according to the invention, the black correction means includes: a subtraction means subtracting the black-approximated data from the image data in units of the predetermined number of color data, to obtain after-subtraction data; and a limiter setting a color data of less than "0" among the predetermined number of color data in the after-subtraction data, to "0", thereby to obtain the after-black-correction image data.

In a fourth aspect of the image display device according to the invention, the black correction means includes: a subtraction means subtracting the black-approximated data from the image data in units of the predetermined number of color data, to obtain after-subtraction data; an addition data generating means generating addition data of not less than "0" based on the after-subtraction data; and an addition means adding the addition data to the after-subtraction data in units of the predetermined number of color data, to obtain the after-black-correction image data.

In a fifth aspect of the image display device according to the invention, the black correction means includes: a subtraction data calculating means multiplying the black-approximated data by a multiplication factor of not more than "1" based on the image data, to obtain subtraction data; and a subtraction means obtaining subtraction data by subtracting the subtraction data from the image data in units of the predetermined number of color data, and outputting the subtraction data as the after-black-correction image data.

In a sixth aspect of the image display device according to the invention, the subtraction data calculating means includes: a multiplication factor calculating means calculating a multiplication factor of not more than "1", based on the image data; and a multiplication means multiplying the black-approximated data by the multiplication factor, to obtain subtraction data, the multiplication factor calculating means includes: a multiplication factor candidate outputting part outputting a predetermined number of multiplication factor candidates corresponding to the predetermined number of color data based on the image data; and a minimum value selecting means selecting a minimum multiplication factor candidate from the predetermined number of multiplication factor candidates and outputting the minimum multiplication factor candidate as the multiplication factor.

In a seventh aspect of the image display device according to the invention, the black correction means includes: a subtraction data calculating means subtracting adjustment data of not less than "0" based on the image data from the black-approximated data, to obtain subtraction data; and a subtraction means subtracting the subtraction data from the image data in units of the predetermined number of color data, to obtain subtraction data, and outputting the subtraction data as the after-black-correction image data.

In an eighth aspect of the image display device according to the invention, the color data contains a predetermined number of color data, and the black correction part includes: a black-approximated data generating means generating a black-approximated data that is data related to at least one of luminance, chromaticity and tristimulus values when the image display means displays black based on the characteristics of the image display means when displaying black; a look-up table storing a table data; and a table data writing means writing, in the look-up table, a table data capable of deriving one of the after-black-correction image data from the black-approximated data and the image data, the look-up table obtaining the after-black-correction image data based on the image data by referring to the table data.

In a ninth aspect of the image display device according to the invention, the color data contains a predetermined number of color data, and the black correction part includes: a black-approximated data generating means generating a black-approximated data that is data related to at least one of luminance, chromaticity and tristimulus values when the image display means displays black based on the characteristics of the image display means when displaying black; a black correction means subtracting the after-black-correction image data from the image data in units of the predetermined number of color data, to output the after-black-correction image data; and a gradation transforming means performing gradation transformation on the after-black-correction image data to output after-gradation-correction image data, the image display means includes an image display means performing image display on the predetermined screen based on the after-gradation-correction image data, and the gradation transforming means obtains the after-gradation-correction image data such that at least one of luminance, chromaticity and tristimulus values of color displayed on the image display means is linear to the after-black correction data.

In a tenth aspect of the image display device according to the invention, the color data contains a predetermined number of color data, and the black correction part includes: an external light detecting means detecting at least one of luminance, chromaticity and tristimulus values of external light irradiating the surface of the predetermined screen of the image display means, to output an external light detection data; and a black-approximated data calculating and generating means calculating and generating a black-approximated data related to the characteristic of the image display means when displaying black based on the external data detection data.

In an eleventh aspect of the image display device according to the invention, the characteristics of the image display means when displaying black contains characteristics of a reflected light of external light on the surface of the predetermined screen of the image display means.

In a twelfth aspect of the image display device according to the invention, the characteristics of the reflected light of external light contains at least one of luminance, chromaticity and tristimulus values of color in the reflected light of external light.

In a thirteenth aspect of the image display device according to the invention, the black-approximated data contains a black-approximated data of which value is set such that a difference between an image index value that is data of at least one of luminance, chromaticity and tristimulus values of color displayed when the black-approximated data is inputted to the image display means in a situation where there is no influence of external light, and the image index value when the image display means displays black, is the image index value in the reflected light of external light.

In a fourteenth aspect of the image display device according to the invention, the characteristics of the image display means when displaying black further contains at least one of luminance, chromaticity and tristimulus values of color when the image display means displays black.

In a fifteenth aspect of the image display device according to the invention, the black-approximated data contains a black-approximated data of which value is set such that a difference between an image index value that is data of at least one of luminance, chromaticity and tristimulus values of color displayed when the black-approximated data is inputted to the image display means in a situation where there is no influence of external light, and the image index value when the image display means displays black, is the image index value of color when the image display means displays black in a situation where there is the influence of external light.

In a sixteenth aspect of the image display device according to the invention, the characteristics of the image display means when displaying black contains at least one of luminance, chromaticity and tristimulus values of color when the image display means displays black in a situation where there is no influence of external light.

With the first aspect of the image display device according to the invention, the image display means performs image display on the predetermined screen based on the after-black-correction image data that is obtained by the black correction part executing black correction processing based on the characteristics of the image display means when displaying black. This produces the effect of performing image display having a large contrast and excellent visibility to the viewer.

At this time, it is unnecessary to change the brightness of display on the image display means, thereby causing no problems of increasing cost and power consumption and decreasing useful lifetime in the image display means.

With the second aspect of the image display device according to the invention, after-black-correction image data can be obtained by such a relatively simple processing that the black correction means performs subtraction processing on image data based on black-approximated data in units of a predetermined number of color data.

With the third aspect of the image display device according to the invention, the placement of the limiter avoids the disadvantage that after-black-correction image data has a value of less then "0".

With the fourth aspect of the image display device according to the invention, the addition means adds addition data of not less than "0" based on after-subtraction data, to after-subtraction data, in units of a predetermined number of color data, thereby obtaining after-black-correction image data. It is therefore avoidable that the after-black-correction image data has a value of less than "0", even when the after-subtraction data has a small value.

With the fifth aspect of the image display device according to the invention, the subtraction data calculating means obtains subtraction data by multiplying black-approximated data by a multiplication factor of not more than "1" based on image data. It is therefore avoidable that the after-black-correction image data has a value of less than "0", even when the image data has a small value.

With the sixth aspect of the image display device according to the invention, the minimum value selecting means selects, as a multiplication factor, the minimum multiplication factor candidate from a predetermined number of multiplication factor candidates. This makes possible to avoid that after-black-correction image data has a value of less than "0", even when the image data has a small value.

With the seventh aspect of the image display device according to the invention, the subtraction data calculating means obtains subtraction data by subtracting adjustment data of not less than "0" based on image data, from black-approximated data. This makes possible to avoid that after-black-correction image data has a value of less than "0", even when the image data has a small value.

With the eighth aspect of the image display device according to the invention, the look-up table realizes the main part of the black correction part, resulting in a simple circuit configuration.

With the ninth aspect of the image display device according to the invention, the gradation transforming means obtains after-gradation-correction image data such that at least one of luminance, chromaticity and tristimulus values of color displayed on the image display means is linear to the after-black-correction data. This produces the effect of performing image display having a large contrast and excellent visibility to the viewer, even when the gradation characteristics of the image display means is non-linear.

With the tenth aspect of the image display device according to the invention, black-approximated data suitable for environment where the image display device is used can be obtained at any time without previously setting black-approximated data, because there is the external-light detecting means that detects at least one of luminance, chromaticity and tristimulus values in external light irradiating the surface of a predetermined screen of the image display means, to output external-light detection data.

With the eleventh aspect of the image display device according to the invention, the characteristics of the image display means when displaying black contains the characteristics of the reflected light of external light on the surface of a predetermined screen of the image display means. This makes possible to perform image display having a large contrast and excellent visibility to the viewer even when there is the influence of external light.

With the twelfth aspect of the image display device according to the invention, the characteristics of the image display means when displaying black contains at least one of luminance, chromaticity and tristimulus values of color in the reflected light of external light. This makes possible to perform image display having a large contrast and excellent visibility to the viewer when the tristimulus values of color in displaying black have large values due to the influence of external light.

With the thirteenth aspect of the image display device according to the invention, even when there is the influence of external light, image display having a large contrast and excellent visibility to the viewer can be performed by using black-approximated data of which value is set such that a differencc between an image index value that is data of at least one of luminance, chromaticity and tristimulus values of color displayed when the black-approximated data is inputted to the image display means in a situation where there is no influence of external light, and the image index value when the image display means displays black, is the image index value in a reflected light of external light.

With the fourteenth aspect of the image display device according to the invention, image display having a large contrast and excellent visibility to the viewer can be performed even when at least one of the luminance, chromaticity and tristimulus values of color when the image display means displays black has a large value, because the characteristics of the image display means when displaying black further contains at least one of luminance, chromaticity and tristimulus values of color when the image display means displays black.

With the fifteenth aspect of the image display device according to the invention, even when the image index value of color when the image display means displays black has a large value, in addition to the influence of external light, image display having a large contrast and excellent visibility to the viewer can be performed because there is contained black-approximated data of which value is set such that a difference between an image index value that is data of at least one of luminance, chromaticity and tristimulus values of color displayed when the black-approximated data is inputted to the image display means in a situation where there is no influence of external light, and the image index value of color when the image display means displays black, is the image index value of color when the image display means display black in a situation where there is the influence of external light.

With the sixteenth aspect of the image display device according to the invention, image display having a large contrast and excellent visibility to the viewer can be performed even when at least one of the luminance, chromaticity and tristimulus values of color when the image display means display black has a large value, because the characteristics of the image display means when displaying black contains at least one of luminance, chromaticity and tristimulus values of color when the image display means displays black.

These and other objects, features, aspects and advantages of the present invention will become more apparent from the following detailed description of the present invention when taken in conjunction with the accompanying drawings.

BRIEF DESCRIPTION OF DRAWINGS

FIG. 3 is an explanatory diagram showing in table the relationship with tristimulus values based on the CIE XYZ calorimetric system of light received by the eyes of a viewer who views the image display device of the first preferred embodiment;

FIG. 4 is an explanatory diagram showing in table the relationship with tristimulus values of color received by the viewer's eyes in a situation where there is no influence of external light;

FIG. 7 is an explanatory diagram showing in table the relationship with tristimulus values based on CIE XYZ colorimetric system of light received by the eyes of a viewer who views the image display device of the second preferred embodiment;

FIG. 8 is an explanatory diagram showing in table the relationship with tristimulus values of color received by the viewer's eyes in a situation where there is the influence of external light;

FIG. 9 is an explanatory diagram showing in table the relationship with tristimulus values of color received by the eyes of a viewer of a virtual image display device;

FIG. 13 is an explanatory diagram showing in table the relationship with tristimulus values based on the CIE XYZ calorimetric system of light received by the eyes of a viewer who views the image display device of this preferred embodiment;

FIG. 18 is an explanatory diagram showing in table the relationship with tristimulus values based on the CIE XYZ colorimetric system of light received by the eyes of a viewer who views the image display device of the fourth preferred embodiment;

FIG. 31 is an explanatory diagram showing in table the relationship with tristimulus values of color received by the viewer's eyes in a situation where there is no influence of external light;

FIG. 33 is an explanatory diagram showing in table the relationship with tristimulus values of color received by the viewer's eyes in a situation where there is the influence of external light;

FIG. 35 is an explanatory diagram showing in table the relationship with tristimulus values of color received by the viewer's eyes in a situation where the brightness of display in an image display means is double the normal and there is the influence of external light.

BEST MODE FOR CARRYING OUT THE INVENTION

1. First Preferred Embodiment

Figure 1:
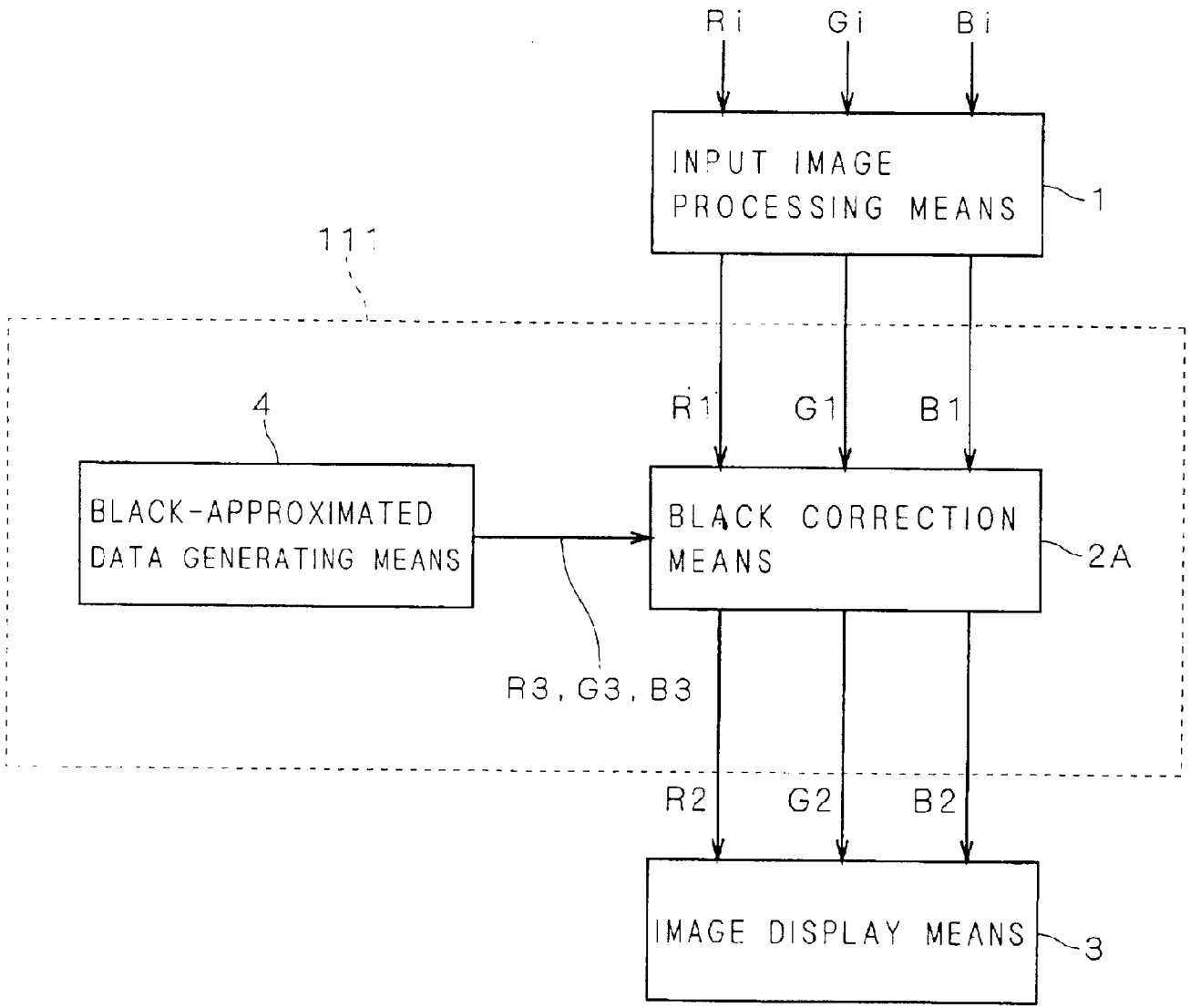
FIG. 1 is a block diagram showing the configuration of an image display device in a first preferred embodiment of the invention.

FIG. 1 is a block diagram showing the configuration of an image display device in a first preferred embodiment of the invention. As shown in FIG. 1, the image display device of the first preferred embodiment is configured with an input image processing means 1, black correction means 2A, image display means 3, and black-approximated data generating means 4. A black correction part 111 is made of the black correction means 2A and black-approximated data generating means 4.

The operation of the image display device of the first preferred embodiment will be described below by referring to FIG. 1. Image data Ri, Gi, and Bi that are composed of three color data inputted to the image display device are inputted to the input image processing means 1. The input image processing means 1 subjects the inputted image data Ri, Gi, and Bi to input image processing and outputs after-input-processing data R1, G1, and B1 composed of three color data.

Figure 30:
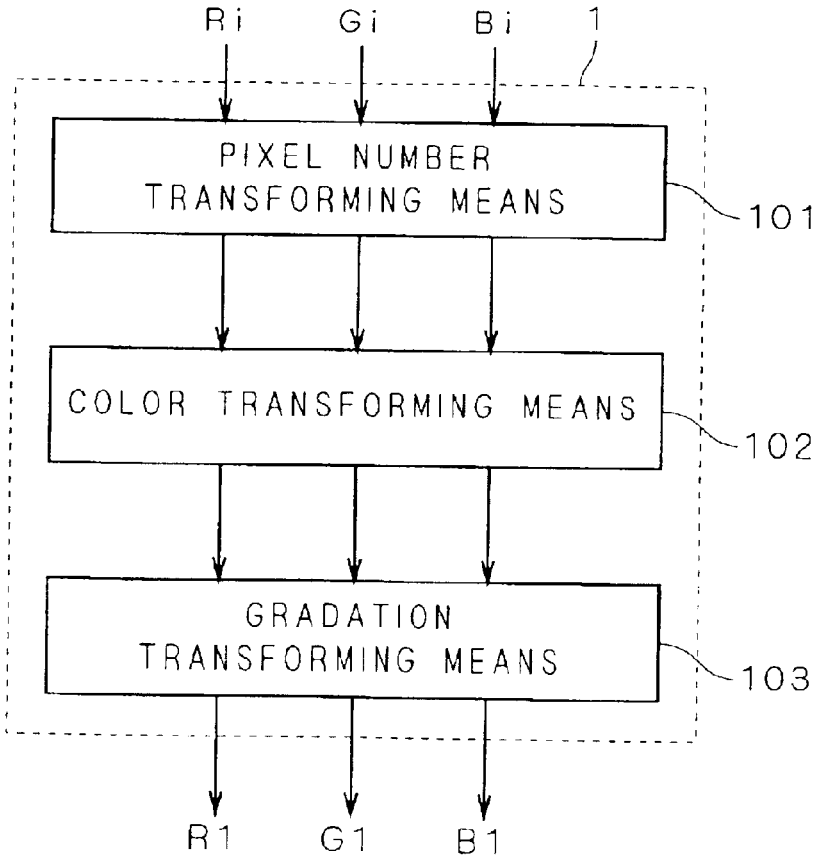
FIG. 30 is a block diagram showing an example of the configuration of an input image processing means in FIG. 29.
Figure 32:
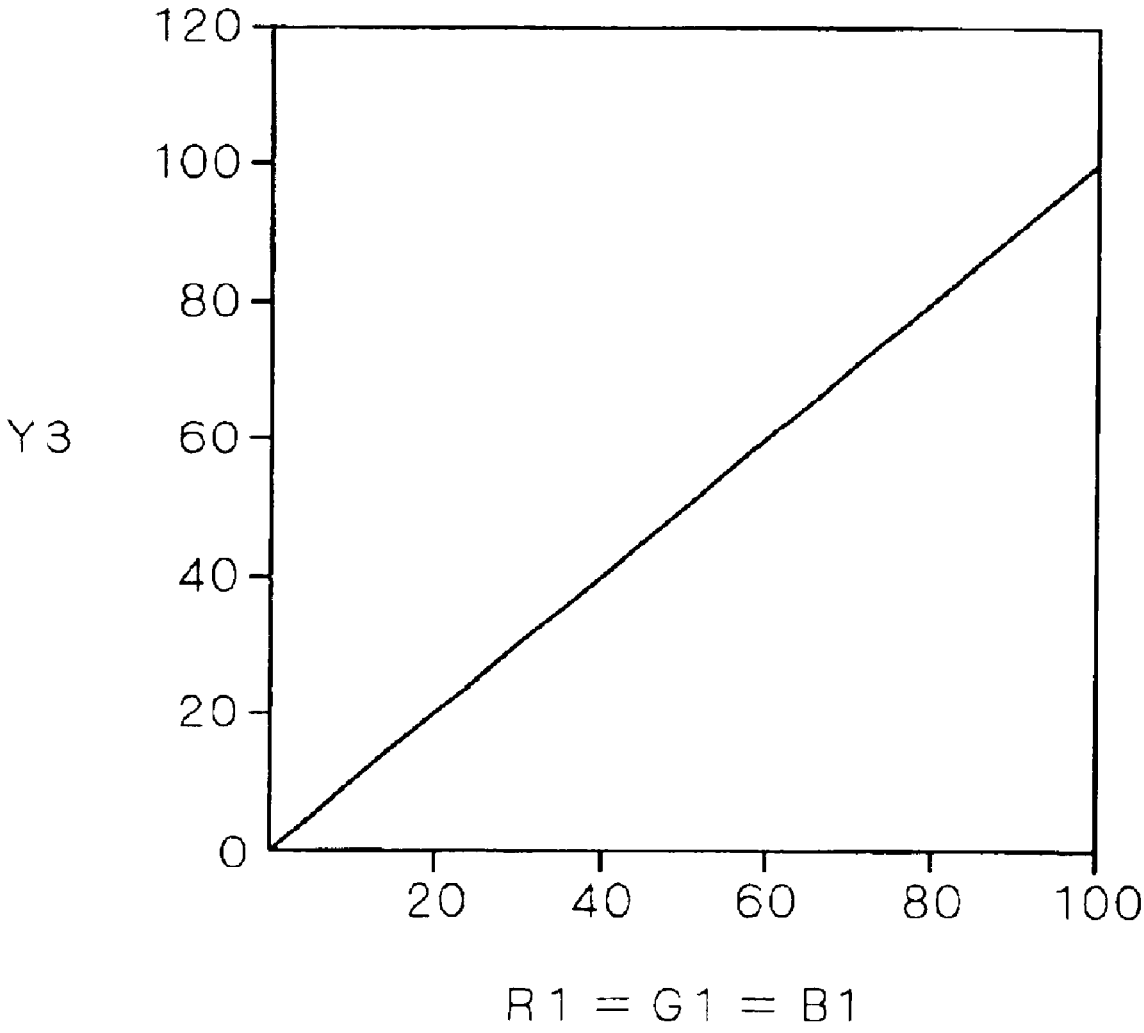
FIG. 32 is a graph showing the relationship between image data inputted to an image display means and luminance stimulus value.
Figure 34:
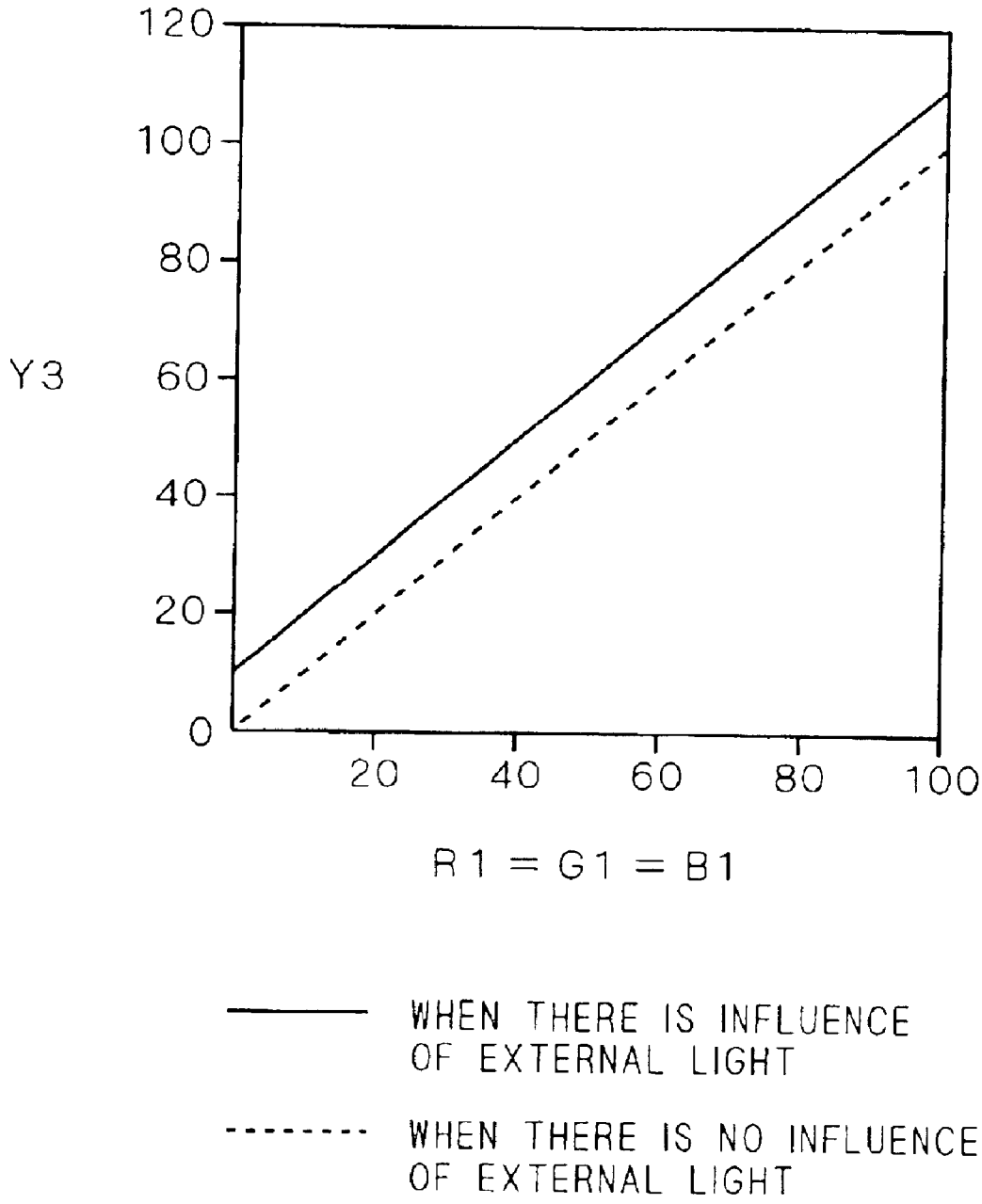
FIG. 34 is a graph showing the relationship between image data inputted to an image display means and luminance stimulus value.

Examples of the input image processing are gradation correction processing, pixel number transformation processing, and color transformation processing, in response to the characteristics of image data inputted, as described in the prior art column (see FIG. 30).

On the other hand, the black-approximated data generating means 4 holds black-approximated data R3, G3, and B3, which are data related to at least one of the luminance, chromaticity, and tristimulus values (three image index values) when displaying black on the image display means 3, and then provides that data to the black correction means 2A.

The black correction means 2A inputs the after-input-processing image data R1, G1, and B1 obtained by the input image processing means 1 and the black approximated data R3, G3, and B3, then calculates and outputs after-black-correction image data R2, G2, and B2. The after-black-correction image data R2, G2, and B2 outputted from the black correction means 2A are sent to the image display means 3.

The term "black correction" in the present specification means correction for black reproducibility and is used as a general term of correction for "black fading" due to the influence of external light, and correction for "black fading" due to the characteristics of the image display means. The term "black fading" means such a phenomenon that black is not the real black but looks brighter gray. The black fading lowers the contrast of image and gives the viewer the impression that the image is whitish as a whole.

Specifically, "black correction" means that when the influence of external light is large, or when the luminance or tristimulus values in displaying black on the image display means are large, image signal processing equates the luminance, chromaticity, or tristimulus values of color displayed on the image display means, with that in a situation where the influence of external light is small, or the luminance or tristimulus values in displaying black on the image display means are small.

The image display means 3 performs image display processing on a predetermined screen by each pixel emitting in response to the value of the corresponding after-black-correction image data R2, G2, and B2. As an example of the image display means 3, there is a liquid crystal panel or CRT.

Figure 2:
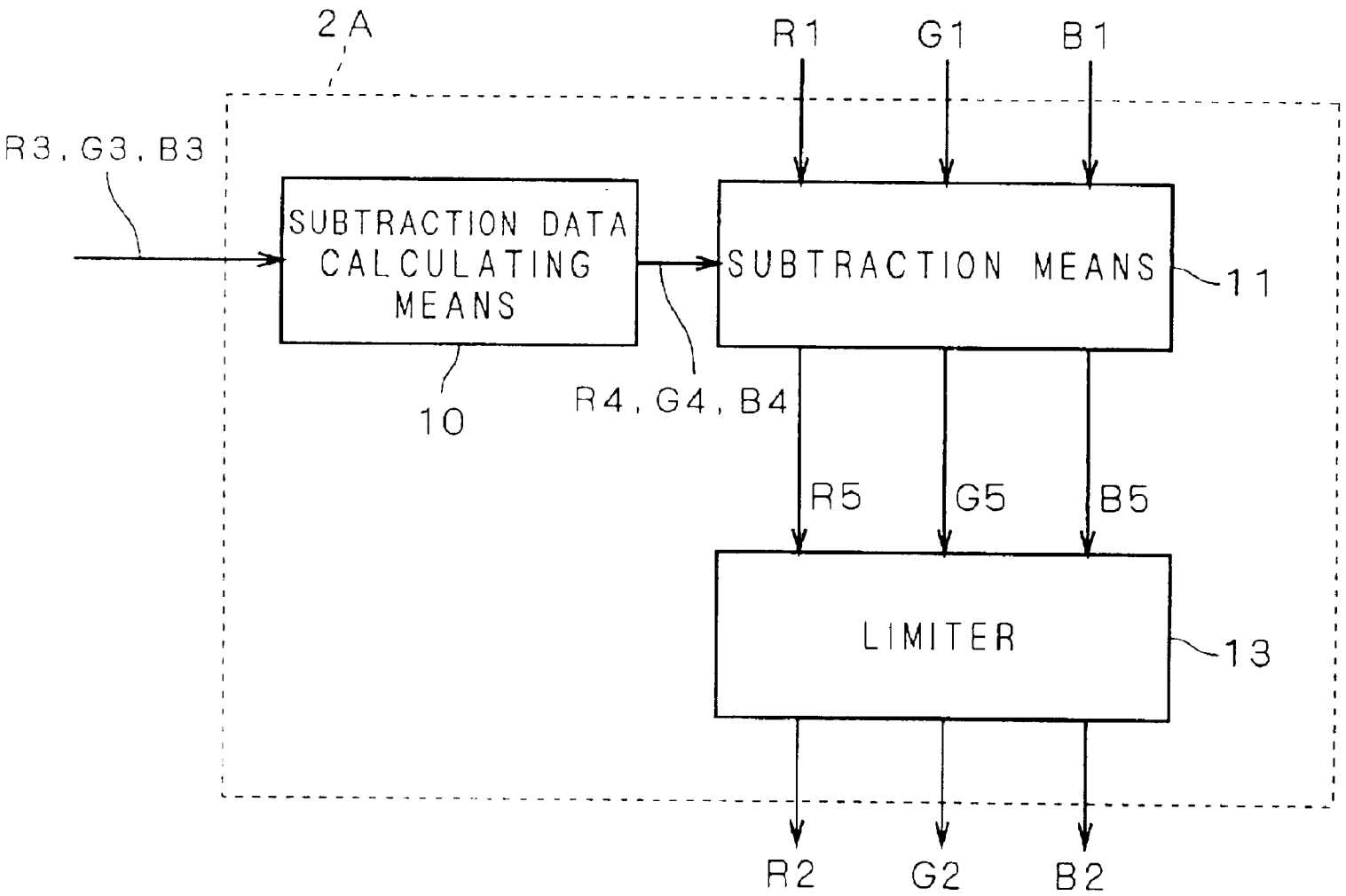
FIG. 2 is a block diagram showing an example of the internal configuration of a black correction means shown in FIG. 1.

FIG. 2 is a block diagram showing an example of the internal configuration of the black correction means 2A shown in FIG. 1. As shown in FIG. 2, the black correction means 2A is configured with a subtraction data calculating means 10, subtraction means 11, and limiter 13.

The operation of the black correction means 2A will be described below by referring to FIG. 2. Black-approximated data R3, G3, and B3 inputted to the black correction means 2A are inputted to the subtraction data calculating means 10. From the inputted black-approximated data R3, G3, and B3, the subtraction data calculating means 10 calculates and outputs subtraction data R4, G4, and B4. The subtraction data calculating means 10 in the first preferred embodiment outputs directly the black-approximated data R3, G3, and B3, as subtraction data R4, G4, and B4, respectively. That is, R4=R3, G4=G3, and B4=B3. The subtraction data calculating means 10 may be configured with hardware or software, such that the black-approximated data R3, G3, and B3 can be directly outputted as subtraction data R4, G4, and B4, respectively.

The subtraction means 11 inputs the after-input-processing image data R1, G1, B1, and the subtraction data R4, G4, B4, then performs a relatively simple subtraction processing shown in the following equation (6), to calculate and output after-subtraction data R5, G5, and B5. The subtraction means 11 may be configured with hardware such as existing subtracter, or realized with software.

$$R5=R1-R4G5=G1-G4B5=B1-B4 \tag{6}$$

The after-subtraction data R5, G5 and B5 outputted from the subtraction means 11 are inputted to the limiter 13. The limiter 13 changes data having a negative value in the after-subtraction data R5, G5, and B5, to "0", whereas it directly outputs data having a value of not less than "0", as after-black-correction data R2, G2, and B2, respectively.

Black-approximated data R3, G3, and B3 will be discussed here. Black-approximated data R3, G3, and B3 are data calculated from the luminance or chromaticity in displaying black on the image display means 3. The luminance or chromaticity when displaying black in a situation where there is no influence of external light, and the luminance or chromaticity of a reflected light of external light, are related to the luminance or chromaticity in displaying black. The luminance or chromaticity when displaying black in a situation where there is no influence of external light is determined by the characteristics of the image display means 3. The luminance or chromaticity of the reflected light of external light is determined by the brightness or chromaticity of the external light irradiating the image display means 3.

Let X1, Y1, and Z1 denote tristimulus values based on the CIE XYZ colorimetric system of color (light) displayed on the image display means 3 when the after-black-correction data R2, G2, and B2 are inputted to the image display means 3 in a situation where there is no influence of external light (hereinafter referred to simply as "tristimulus values"). Suppose that the image display means 3 is such an image display means 3 in which the relationship between the size of after-black-correction image data R2, G2, and B2 to be inputted, and tristimulus values X1, Y1, and Z1 of color (light) to be displayed can be expressed in the following equation (7). Here, the tristimulus values correspond to luminance and chromaticity, and Y1 of the tristimulus values is a value corresponding to a luminance.

$$\begin{bmatrix} X1 \\ Y1 \\ Z1 \end{bmatrix} = \begin{bmatrix} axr & axg & axb \\ ayr & ayg & ayb \\ azr & azg & azb \end{bmatrix} \begin{bmatrix} R2 \\ G2 \\ B2 \end{bmatrix} + \begin{bmatrix} Xbk1 \\ Ybk1 \\ Zbk1 \end{bmatrix} \tag{7}$$

In equation (7), axr, ayr, azr, axg, ayg, azg, axb, ayb, azb; and Xbk1, Ybk1, Zbk1, are values that depend on the characteristics of the image display means 3. In particular, Xbk1, Ybk1, and Zbk1 are tristimulus values of color (light) displayed on the image display means 3 when displaying black on the image display means 3 in a situation where there is no influence of external light, that is, when R2=G2=B2=0. Here, axr, ayr, azr, axg, ayg, azg, axb, ayb, and azb are values expressed in the following equation (8):

$$axr=0.4124,\ axg=0.3576,\ axb=0.1805,\ ayr=0.2126,\ ayg=0.7152,\ ayb=0.0722,\ azr=0.0193,\ azg=0.1192,\ azb=0.9505 \tag{8}$$

After-input-processing data R1, G1, and B1 to be outputted from the input image processing means 1 are integers and values in the range expressed in the following equation (9):

$$0 \leqq R1 \leqq 100 \quad 0 \leqq G1 \leqq 100 \quad 0 \leqq B1 \leqq 100 \tag{9}$$

Let X2, Y2, and Z2 denote tristimulus values of a reflected light caused by that external light irradiates the surface of a predetermined screen of the image display means 3 and the external light is reflected from the surface of the image display means 3. In this case, tristimulus values X3, Y3, and Z3 of light received by the eyes of a viewer who views the image display device can be expressed in the sum of tristimulus values X1, Y1, and Z1 of color that are displayed on the image display means 3 by the after-black-correction data R2, G2, and B2, and the tristimulus values X2, Y2, and Z2 of the reflected light. That is, X3, Y3 and Z3 can be expressed in the following equation (10). The viewer seems as if the color expressed by X3, Y3, and Z3 were displayed on the image display means 3.

$$\begin{bmatrix} X3 \\ Y3 \\ Z3 \end{bmatrix} = \begin{bmatrix} X1 \\ Y1 \\ Z1 \end{bmatrix} + \begin{bmatrix} X2 \\ Y2 \\ Z2 \end{bmatrix} = \begin{bmatrix} axr & axg & axb \\ ayr & ayg & ayb \\ azr & azg & azb \end{bmatrix} \begin{bmatrix} R2 \\ G2 \\ B2 \end{bmatrix} + \begin{bmatrix} Xbk1+X2 \\ Ybk1+Y2 \\ Zbk1+Z2 \end{bmatrix} \tag{10}$$

In equation (10), Xbk1+X2, Ybk1+Y2, and Zbk1+Z2 are tristimulus values in displaying black on the image display means 3, taking the influence of external light into consideration. From equation (10), the variations in value of tristimulus values Xbk1, Ybk1, and Zbk1 in displaying black in a situation where there is no influence of external light, and the variations in value of tristimulus values X2, Y2, and Z2 of a reflected light of external light, have the same influence on the tristimulus values X3, Y3, and Z3 of light received by the viewer's eyes. In this preferred embodiment, correction is made for the influence due to the tristimulus values X2, Y2, and Z2 of a reflected light of external light. Here, Xbk1, Ybk1, and Zbk1 are values expressed in the following equation (11):

$$Xbk1=1Ybk1=1Zbk1=1 \tag{11}$$

When the influence of tristimulus values X2, Y2, and Z2 of a reflected light of external light is corrected by the black correction means 2A, it is assumed that the tristimulus values X2, Y2, and Z2 of the reflected light of external light are due to a virtual emission in the image display means 3. In this case, black-approximated data R3, G3, and B3 are data to be inputted to the image display means 3, for the purpose of causing the virtual emission. Here, especially use after-black-correction data R20, G20, and B20 for after-black-correction image data R2, G2, and B2 to be inputted to the image display means 3 in a situation where there is no influence of external light. Then, tristimulus values of color (light) displayed on the image display means 3 in a situation where there is no influence of external light can be expressed in the following equation (12), which is obtained by replacing R2, G2, and B2 in equation (7), with after-black-correction image data R20, G20, and B20, respectively.

$$\begin{bmatrix} X1 \\ Y1 \\ Z1 \end{bmatrix} = \begin{bmatrix} axr & axg & axb \\ ayr & ayg & ayb \\ azr & azg & azb \end{bmatrix} \begin{bmatrix} R20 \\ G20 \\ B20 \end{bmatrix} + \begin{bmatrix} Xbk1 \\ Ybk1 \\ Zbk1 \end{bmatrix} \tag{12}$$

In a situation where there is the influence of external light, the above tristimulus values X2, Y2, and Z2 of the reflected light of external light can be considered as an increment of virtual emission caused by the black-approximated data R3, G3, and B3 in the image display means 3. Therefore, the above equation (10) can be rewritten to the following equation (13):

$$\begin{bmatrix} X3 \\ Y3 \\ Z3 \end{bmatrix} = \begin{bmatrix} X1 \\ Y1 \\ Z1 \end{bmatrix} + \begin{bmatrix} X2 \\ Y2 \\ Z2 \end{bmatrix} = \begin{bmatrix} axr & axg & axb \\ ayr & ayg & ayb \\ azr & azg & azb \end{bmatrix} \begin{bmatrix} R20+R3 \\ G20+G3 \\ B20+B3 \end{bmatrix} + \begin{bmatrix} Xbk1 \\ Ybk1 \\ Zbk1 \end{bmatrix} \quad (13)$$

From equations (12) and (13), the following equation (14) can be obtained.

$$\begin{bmatrix} R3 \\ G3 \\ B3 \end{bmatrix} = \begin{bmatrix} axr & axg & axb \\ ayr & ayg & ayb \\ azr & azg & azb \end{bmatrix}^{-1} \begin{bmatrix} X2 \\ Y2 \\ Z2 \end{bmatrix} \quad (14)$$

Accordingly, with the use of equation (14), black-approximated data R3, G3, and B3 can be obtained from the tristimulus values X2, Y2, and Z2 of the reflected light of external light on the surface of the predetermined screen of the image display means 3. If Z2, Y2, and Z2 are already obtained by measurement etc., black-approximated data R3, G3, and B3 may be calculated from equation (14), and set them to the black-approximated data generating means. Tristimulus values are numerical values expressing the chromaticity and luminance of the light.

Tristimulus values X31, Y31, and Z31 of color displayed when black-approximated data R3, G3, and B3 are inputted to the image display means 3, are X3, Y3, and Z3 to be obtained when R2=R3, G2=G3, and B2=B3 in equation (10). From equations (14) and (10), it can be expressed by the following equation (15):

$$\begin{bmatrix} X31 \\ Y31 \\ Z31 \end{bmatrix} = \begin{bmatrix} X2 \\ Y2 \\ Z2 \end{bmatrix} + \begin{bmatrix} Xbk1+X2 \\ Ybk1+Y2 \\ Zbk1+Z2 \end{bmatrix} \quad (15)$$

Tristimulus values X30, Y30, and Z30 in displaying black on the image display means 3 can be obtained for R2=0, G2=0, and B2=0 in equation (10), and expressed in the following equation (16):

$$\begin{bmatrix} X30 \\ Y30 \\ Z30 \end{bmatrix} = \begin{bmatrix} Xbk1+X2 \\ Ybk1+Y2 \\ Zbk1+Z2 \end{bmatrix} \quad (16)$$

From equations (15) and (16), a difference between the tristimulus values X31, Y31, and Z31 of color displayed when black-approximated data R3, G3, and B3 are inputted to the image display means 3, and the tristimulus values X30, Y30, and Z30 in displaying black on the image display means 3, can be expressed in tristimulus values X2, Y2, and Z2 of a reflected light of external light on the surface of a predetermined screen of the image display means 3.

On the other hand, if obtained only Y2 expressing luminance in the tristimulus values X2, Y2, and Z2 of a reflected light of external light on the surface of a predetermined screen of the image display means 3, suppose a spectral distribution of the reflected light of external light for obtaining X2 and Z2. Then, from equation (14), black-approximated data R3, G3, and B3 can be calculated and set to the black-approximated data generating means 4. Suppose, for example, that the spectral distribution of the reflected light of external light is the same as the spectral distribution of D65 that is a standard light source, X2:Y2:Z2=0.9505:1:1.089. From the value of Y2, the values of X2 and Z2 can be found.

It should be noted that when X2 and Z2 are found from the luminance Y2 of the reflected light of external light by supposing the spectrum distribution of the reflected light of external light, a difference between the actual spectrum distribution of external light and the supposed spectrum distribution leads to a chromaticity difference of color displayed on the image display means 3 based on the after-black-correction image data R2, G2, and B2.

The following is a specific example of the effects according to the image display device of the first preferred embodiment. Suppose that the tristimulus values of a reflected light of external light on the surface of a predetermined screen of the image display means 3 are X3=9.505, Y3=10, and Z3=10.89. Then, from equation (14), black-approximated data are R3=10, G3=10, and B3=10. In the first preferred embodiment, R4=R3, G4=G3, and B4=B3 are established between subtraction data R4, G4, B4, and black-approximated data R3, G3, B3. Therefore, after-subtraction data R5, G5, and B5 outputted from the subtraction means 11 can be expressed in the following equation (17):

$$R5=R1-10 \quad G5=G1-10 \quad B5=B1-10 \quad (17)$$

Here, the after-subtraction data R5, G5, and B5 have negative values when the after-input-processing image data R1, G1, and B1 have values of less than 10. Therefore, in the limiter 13, such negative values are replaced with "0" and then outputted as after-black-correction data R2, G2, and B2.

The image display device of the first preferred embodiment can remove the influence of external light in a pseudo fashion by subtracting subtraction data R4, G4, and B4 (=after-black-correction image data R2, G2, and B2) from the after-input-processing image data R1, G1, and B1.

FIG. 3 is an explanatory diagram showing in table the relationship among after-input-processing image data R1, G1, B1, after-black-correction data R2, G2, B2, and tristimulus values X3, Y3, Z3 based on the CIE XYZ colorimetric system of color (light) received by the viewer's eyes in a situation where there is the influence of external light, in the image display device of the first preferred embodiment. Specifically, FIG. 3 shows the instance that the relationship of R1=G1=B1 is established, i.e., an achromatic data is inputted to the black correction means 2A.

In FIG. 3, the ratio of Y3 that corresponds to luminance in the tristimulus values of color (light) received by the viewer's eyes when after-black-correction image data R2, G2, and B2 are respectively inputted to the image display means 3, to Y3 (Ymax) when R1=100, G1=100, and B1=100 (when displaying white), is indicated as a ratio to white (Y/Ymax).

FIG. 4 is an explanatory diagram showing in table the relationship between after-input-processing image data R1, G1, B1, and tristimulus values X3, Y3, Z3 of color (light) received by the viewer's eyes, in a situation where there is no influence of external light. Note that in a situation where there is no influence of external light, black-approximated data are expressed in R3=0, G3=0, and B3=0.

A comparison of FIG. 3 with FIG. 4 indicates that in the image display device of the first preferred embodiment, the equivalent display to that in a situation where there is no influence of external light is obtainable when after-input-processing image data R1, G1, B1 have values larger than black-approximated data R3, G3, B3 (=10, 10, 10).

In general, black-approximated data R3, G3, and B3 usually have values as small as about one tenth of after-input-processing image data R1, G1, and B1. With the image display device of the first preferred embodiment, the equivalent display to that in a situation where there is no influence of external light is obtainable with respect to most data, even when there is the influence of external light. This makes possible to provide image having a large contrast and excellent visibility to the viewer.

Further in the image display device of the first preferred embodiment, image processing to data inputted to the image display means 3 is performed without changing the brightness of display on the image display means 3, thus causing no problems of increasing cost and power consumption and decreasing useful life.

Figure 5:
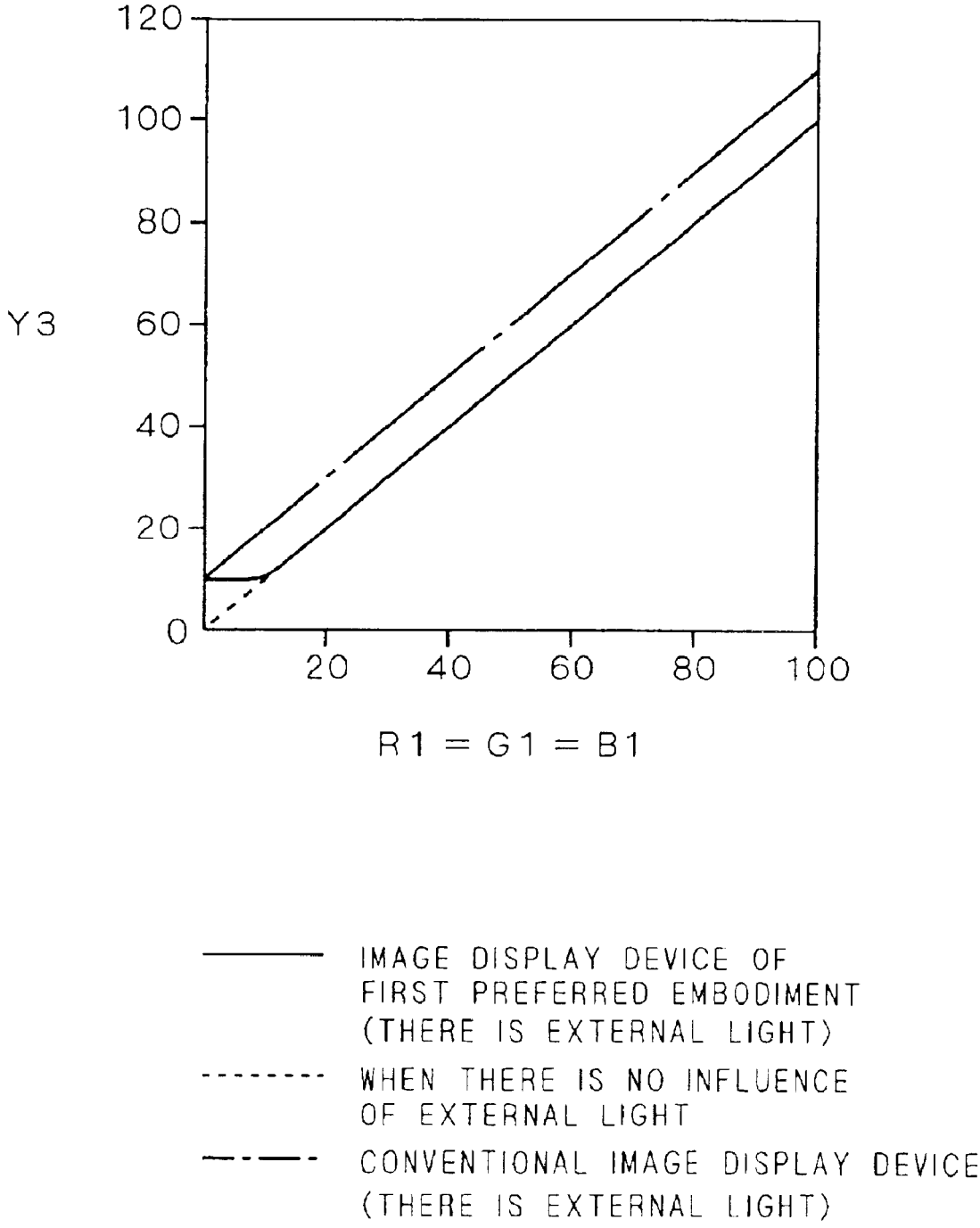
FIG. 5 is a graph showing the relationship between after-input-processing image data and luminance stimulus value.

FIG. 5 is a graph showing the relationship between after-input-processing image data R1, G1, B1, and a luminance stimulus value Y3. In FIG. 5, a continuous line represents the image display device of this invention when there is the influence of external light; an alternate long and short dash line represents a conventional image display device when there is the influence of external light; and a dotted line represents the case where there is no influence of external light. From FIG. 5, it can be easily understood that the equivalent display to that in a situation where there is no influence of external light is obtainable when after-input-processing image data R1, G1, B1 have values larger than black-approximated data R3, G3, B3 (=10, 10, 10).

2. Second Preferred Embodiment

In the first preferred embodiment, the black-approximated data R3, G3, and B3 are set so as to adjust only the influence of the tristimulus values X2, Y2, and Z2 of a reflected light of external light. When tristimulus values in displaying black have large values due to both of the influence of external light and the characteristics of the image display means, black-approximated data R3, G3, and B3 can also be set so as to mitigate such influences.

Figure 6:
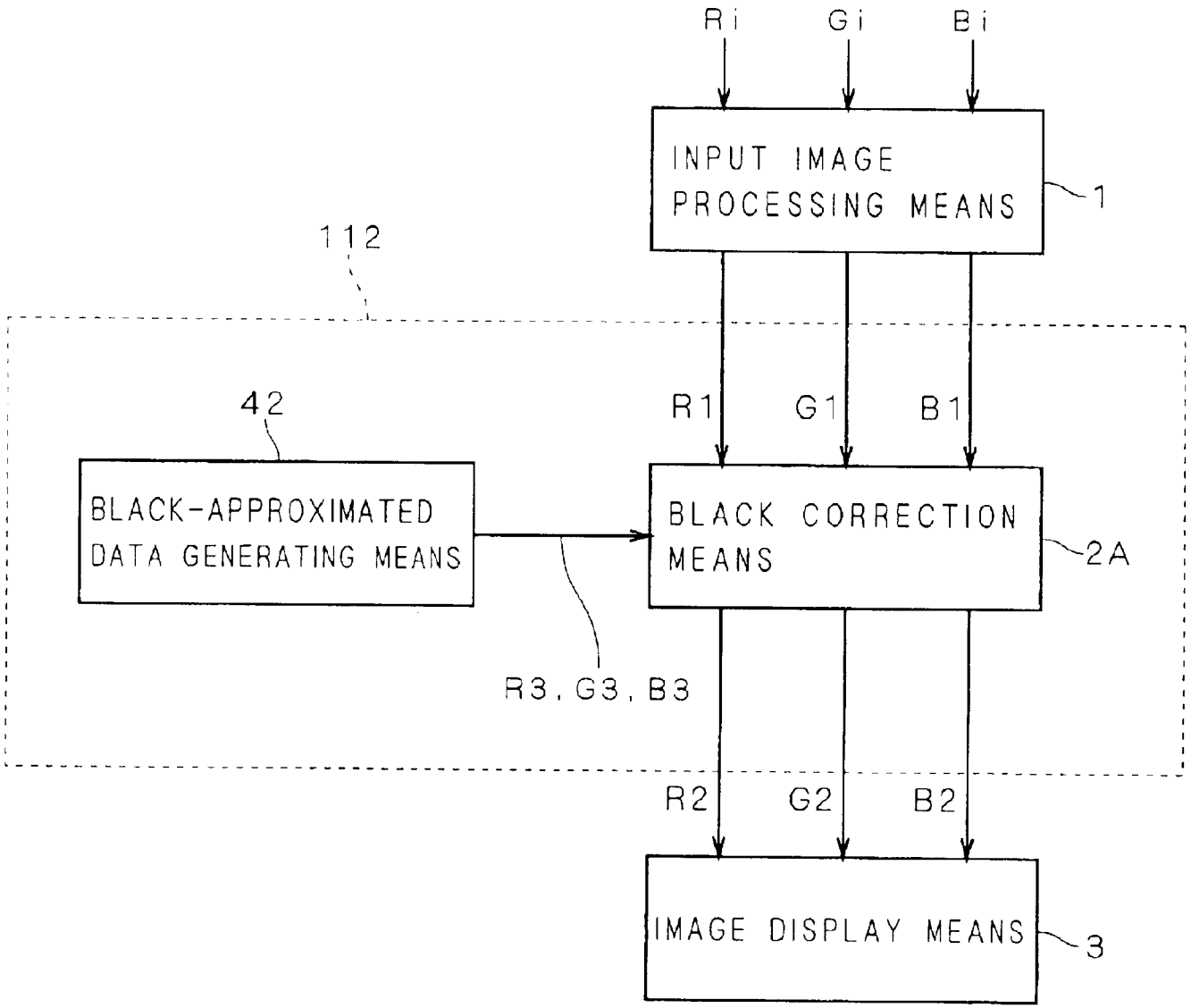
FIG. 6 is a block diagram showing the configuration of an image display device in a second preferred embodiment of the invention.

FIG. 6 is a block diagram showing the configuration of an image display device that is a second preferred embodiment of the invention. As shown in FIG. 6, the overall configuration of the second preferred embodiment is the same as that of the first preferred embodiment, except that the black-approximated data generating means 4 is replaced with a black-approximated data generating means 42. The black-approximated data generating means 42 generates black-approximated data R3, G3, and B3, which are different from those of the black-approximated data generating means 4. That is, a black correction part 112 is made up of the black correction means 2A and black-approximated data generating means 42.

Like the first preferred embodiment, X2, Y2, and Z denote tristimulus values of a reflected light caused by that external light irradiates the surface of a predetermined screen of the image display means 3 and the external light is reflected from the surface of the predetermined screen of the image display means 3. In this case, tristimulus values X3, Y3, and Z3 of light received by the eyes of a viewer who views the image display device can be expressed in the sum of tristimulus values X1, Y1, and Z1 of color displayed on the image display means 3 by after-black-correction image data R2, G2, and B2, and tristimulus values X2, Y2, and Z2 of the reflected light. That is, X3, Y3, and Z3 can be expressed in the following equation (18). The foregoing operation is the same as the first preferred embodiment.

$$\begin{bmatrix} X3 \\ Y3 \\ Z3 \end{bmatrix} = \begin{bmatrix} axr & axg & axb \\ ayr & ayg & ayb \\ azr & azg & azb \end{bmatrix} \begin{bmatrix} R2 \\ G2 \\ B2 \end{bmatrix} + \begin{bmatrix} Xbk1 + X2 \\ Ybk1 + Y2 \\ Zbk1 + Z2 \end{bmatrix} \tag{18}$$

In equation (18), axr, ayr, azr, axg, ayg, azg, axb, ayb, azb; and Xbk1, Ybk1, Zbk1, are values that depend on the characteristics of the image display means 3. In particular, Xbk1, Ybk1, and Zbk1 are tristimulus values of color (light) displayed on the image display means 3 when the image display means 3 displays black in a situation where there is no influence of external light, that is, when R2=G2=B2=0. Although tristimulus values in displaying black Xbk1, Ybk1, and Zbk1 have in fact values larger than "0", all of their values should theoretically be "0", and it is desirable that their values are as small as possible.

When the influences due to the tristimulus values Xbk1, Ybk1, and Zbk1 in displaying black on the image display means 3 in a situation where there is no influence of external light, and the tristimulus values X2, Y2, and Z2 of a reflected light of external light, are corrected by the black correction means 2A, black-approximated data R3, G3, and B3 can be obtained from the following equation (19):

$$\begin{bmatrix} R3 \\ G3 \\ B3 \end{bmatrix} = \begin{bmatrix} axr & axg & axb \\ ayr & ayg & ayb \\ azr & azg & azb \end{bmatrix}^{-1} \begin{bmatrix} Xbk1 + X2 \\ Ybk1 + Y2 \\ Zbk1 + Z2 \end{bmatrix} \tag{19}$$

If Z2, Y2, and Z2 are obtained by measurement etc., black-approximated data R3, G3, and B3 may be calculated from equation (19) and set them to the black-approximated data generating means. Tristimulus values are numerical values expressing the chromaticity and luminance of the light.

Tristimulus values X31, Y31, and Z31 of color displayed when black-approximated data R3, G3, and B3 are inputted to the image display means 3, are X3, Y3, and Z3 to be obtained when R2=R3, G2=G3, and B2=B3 in equation (18), and can be expressed in the following equation (20), which is obtained from equations (19) and (18).

$$\begin{bmatrix} X31 \\ Y31 \\ Z31 \end{bmatrix} = \begin{bmatrix} Xbk1 + X2 \\ Ybk1 + Y2 \\ Zbk1 + Z2 \end{bmatrix} + \begin{bmatrix} Xbk1 + X2 \\ Ybk1 + Y2 \\ Zbk1 + Z2 \end{bmatrix} \tag{20}$$

Tristimulus values X30, Y30, and Z30 in displaying black on the image display means 3 can be obtained for R2=0, G2=0, and B2=0 in equation (18), and expressed in the following equation (21):

$$\begin{bmatrix} X30 \\ Y30 \\ Z30 \end{bmatrix} = \begin{bmatrix} Xbk1 + X2 \\ Ybk1 + Y2 \\ Zbk1 + Z2 \end{bmatrix} \tag{21}$$

From equations (20) and (21), a difference between the tristimulus values X31, Y31, and Z31 of color displayed when black-approximated data R3, G3, and B3 are inputted to the image display means 3, and the tristimulus values X30, Y30, and Z30 in displaying black on the image display means 3, can be expressed in tristimulus values Xbk1+X2, Ybk1+Y2, and Zbk1+Z2 in displaying black on the image display means 3 when there is the influence of external light.

On the other hand, if given only Y2 expressing luminance in the tristimulus values X2, Y2, and Z2 of a reflected light of external light on the surface of a predetermined screen of the image display means 3, X2 and Z2 can be obtained by supposing a spectral distribution of the reflected light of external light. Then, from equation (19), black-approximated data R3, G3, and B3 can be calculated and set to the black-approximated data generating means 42. Supposing, for example, that the spectral distribution of the reflected light of external light is the same as the spectral distribution of D65 that is a standard light source, X2:Y2:Z2=0.9505:1:1.089. Therefore, the values of X2 and Z2 can be found from the value of Y2.

It should be noted that when X2 and Z2 are found by supposing the spectrum distribution of the reflected light of external light from the luminance Y2 of the reflected light of external light, a difference between the actual spectrum distribution of external light and the supposed spectrum distribution leads to a chromaticity difference of color displayed on the image display means 3 based on the after-black-correction image data R2, G2, and B2.

The following is a specific example the effects of the second preferred embodiment. Suppose that the tristimulus values of a reflected light of external light on the surface of a predetermined screen of the image display means 3 are X3=9.505, Y3=10, and Z3=10.89. Further suppose that tristimulus values in displaying black on the image display means 3 are Xbk1=10, Ybk1=10, Zbk1=10. Then, from equation (19), black-approximated data are R3=22, G3=19, and B3=19. In this preferred embodiment, R4=R3, G4=G3, and B4=B3. Therefore, after-subtraction data R5, G5, and B5 to be outputted from the subtraction means 11 can be expressed in the following equation (22):

$$R5=R1-22G5=G1-19B5=B1-19 \quad (22)$$

Here, after-subtraction data has a negative value when after-input-processing data has a value of less than 22. Therefore, in the limiter 13, such negative value is replaced with "0", and outputted as after-black-correction data R2, G2, and B2, respectively.

The image display device of the second preferred embodiment can remove in a pseudo fashion the influences due to the tristimulus values Xbk1, Ybk1, Zbk1 in displaying black on the image display means, and the tristimulus values X2, Y2, Z2 of a reflected light of external light, by subtracting subtraction data R4, G4, and B4 (=after-black-correction image data R3, G3, and B3) from the after-input-processing image data R1, G1, and B1.

FIG. 7 is an explanatory diagram showing in table the relationship among after-input-processing image data R1, G1, B1, after-black-correction data R2, G2, B2, and tristimulus values X3, Y3, Z3 of color (light) received by the viewer's eyes, in a situation where there is the influence of external light, in the image display device of the second preferred embodiment. FIG. 7 shows the instance that the relationship of R1=G1=B1 holds, i.e., an achromatic data is inputted to the black correction means 2A.

In FIG. 7, the ratio of Y3 that corresponds to luminance in the tristimulus values of color (light) received by the viewer's eyes when after-black-correction image data R2, G2, and B2 are respectively inputted to the image display means 3, to Y3 (Ymax) when R1=100, G1=100, and B1=100 (when displaying white), is indicated as a ratio to white (Y/Ymax).

FIG. 8 is an explanatory diagram showing in table the relationship between after-input-processing image data R1, G1, B1, and the tristimulus values X3, Y3, Z3 of color (light) received by the viewer's eyes, when black-approximated data are R3=0, G3=0, and B3=0 in a situation where there is the influence of external light, that is, when no correction is performed in the black correction means 2A.

FIG. 9 is an explanatory diagram showing in table the relationship between after-input-processing image data R1, G1, and B1 of a virtual image display device and tristimulus values X3, Y3, and Z3 of color (light) received by the viewer's eyes in a situation where there is no influence of external light and it is assumed that Xbk1=Ybk1=Zbk1=0.

From comparison of FIG. 7 with FIG. 9, in the image display device of the second preferred embodiment, the equivalent display to that in the virtual image display device in which there is no influence of external light on the tristimulus values X3, Y3, and Z3, and it is assumed that Xbk1=Ybk1=Zbk1=0, is realized when after-input-processing image data R1, G1, B1 have values larger than black-approximated data R3, G3, B3 (R3=22, G3=19, B3=19).

In general, black-approximated data R3, G3, and B3 usually have values smaller than after-input-processing image data R1, G1, and B1. With the image display device of the second preferred embodiment, even when the tristimulus values in displaying black have large values due to both of the influence of external light and the characteristics of the image display means, the equivalent display to that in a situation where the tristimulus values in displaying black are "0" is obtainable with respect to most data. This makes possible to provide image having a large contrast and excellent visibility to the viewer.

Figure 10:
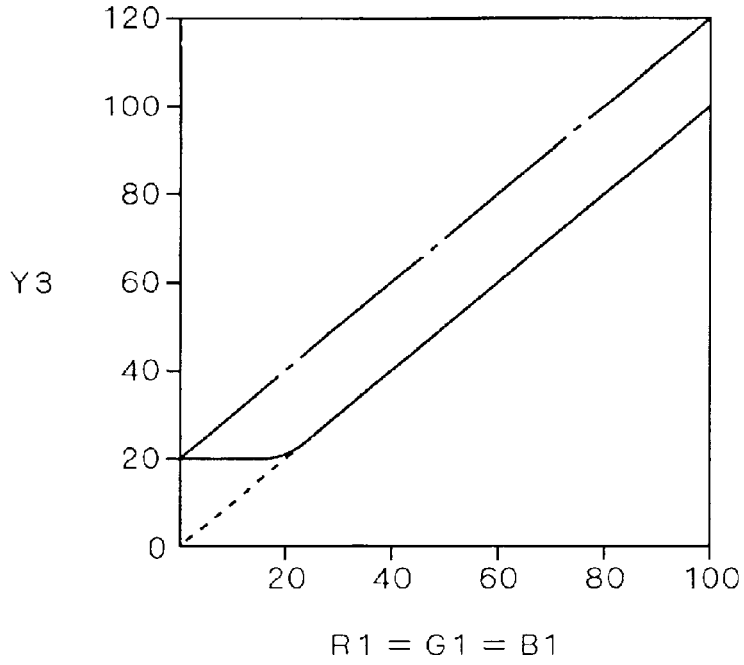
FIG. 10 is a graph showing the relationship between after-input-processing image data and luminance stimulus value.

FIG. 10 is a graph showing the relationship between after-input-processing image data R1, G1, B1, and a luminance stimulus value Y3. In FIG. 10, a continuous line represents the image display device of the present invention when the tristimulus values in displaying black have large values due to both of the influence of external light and the characteristics of the image display means; an alternate long and short dash line represents a conventional image display device when the tristimulus values in displaying black have large values due to both of the influence of external light and the characteristics of the image display means; and a dotted line represents the case where there is no influence of external light, and Xbk1=Ybk1=Zbk1=0.

In the second preferred embodiment, when the tristimulus values in displaying black have large values due to both of the influence of external light and the characteristics of the image display means, the values of black-approximated data are set so as to perform the equivalent display to that when the tristimulus values in displaying black are "0". However, it is not necessarily required to do so. Specifically, after defining predetermined values of tristimulus values in displaying black, the values of black-approximated data may be set so as to perform the equivalent display to that in a situation where the tristimulus values in displaying black are the predetermined values.

3. Third Preferred Embodiment

Figure 11:
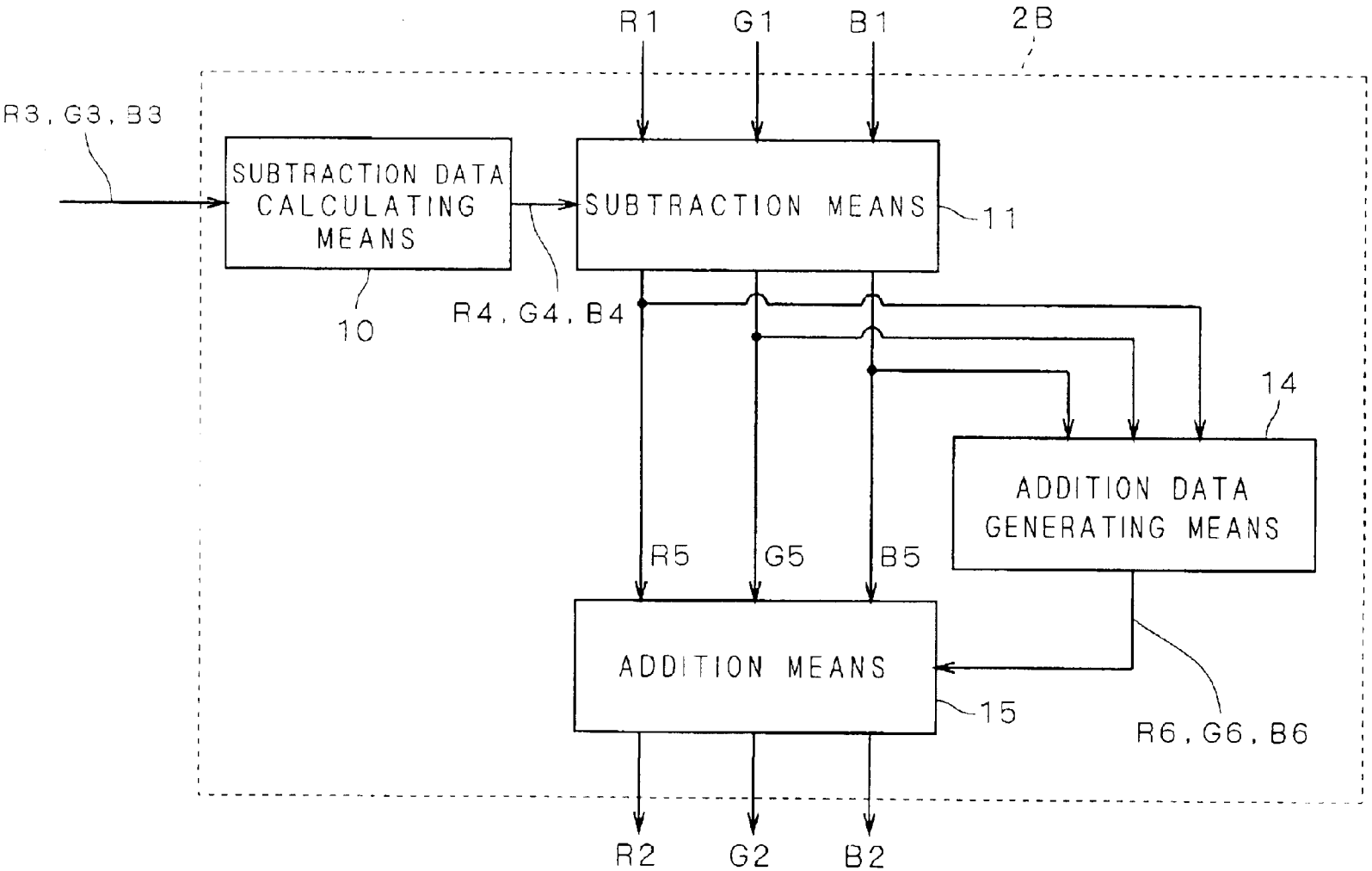
FIG. 11 is a block diagram showing the configuration of a black correction means in an image display device according to a third preferred embodiment of the invention.

FIG. 11 is a block diagram showing the configuration of a black correction means in an image display device according to a third preferred embodiment of the invention. As shown in FIG. 11, a black correction means 2B is configured with a subtraction data calculating means 10, subtraction means 11, addition data generating means 14, and addition means 15. The subtraction data calculating means 10 and subtraction means 11 are the same as in the first preferred embodiment shown in FIG. 2. The overall configuration is the same as that of the first preferred embodiment shown in FIG. 1, except that the black correction means 2A is replaced with the black correction means 2B.

Referring to FIG. 11, as in the case with the first preferred embodiment, black-approximated data R3, G3, and B3 inputted to the black correction means 2B are inputted to the subtraction data calculating means 10, and subtraction data R4, G4, and B4 are calculated in the subtraction data calculating means 10. The subtraction data calculating means 10 of this preferred embodiment outputs directly black-approximated data as subtraction data. That is, R4=R3, G4=G3, and B4=B3. The subtraction means 11 inputs the after-input-processing image data R1, G1, B1, and the subtraction data R4, G4, B4, then performs subtraction processing to calculate and output after-subtraction data R5, G5, and B5.

The addition data generating means 14 inputs the after-subtraction data R5, G5, and B5 that are the output from the subtraction means 11, then generates addition data R6, G6, and B6 that correspond to the values of the after-subtraction data R5, G5, and B5, respectively. Here, when the after-subtraction data R5, G5, and B5 are of more than a predetermined threshold value, the values of addition data R6, G6, and B6 are changed to "0". The addition data generating means 14 can be realized by, for example, a look-up table using memory.

The addition means 15 inputs the after-subtraction data R5, G5, B5 that are the output from the subtraction means 11, and the addition data R6, G6, B6, then calculates after-black-correction data R2, G2, B2, by addition processing expressed in the following equation (23). The addition means 15 may be configured with hardware such as existing adder, or with software.

$$R2=R5+R6 G2=G5+G6 B2=B5+B6 \quad (23)$$

In the third preferred embodiment, like the first preferred embodiment, it is supposed that the tristimulus values of a reflected light of external light on the surface of a predetermined screen of the image display means 3 are X3=9.505, Y3=10, and Z3=10.89. Here, black-approximated data are R3=10, G3=10, and B3=10. Since in this preferred embodiment, R4=R3, G4=G3, and B4=B3, after-subtraction data R5, G5, and B5 to be outputted from the subtraction means 11 can be expressed in the following equation (24):

$$R5=R1-10 G5=G1-10 B5=B1-10 \quad (24)$$

Figure 12A:
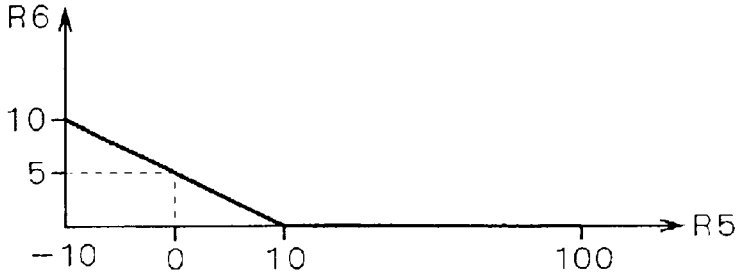
FIGS. 12(*a*) to 12(*c*) are graphs showing the relationship between after-subtraction data and addition data.
Figure 12B:
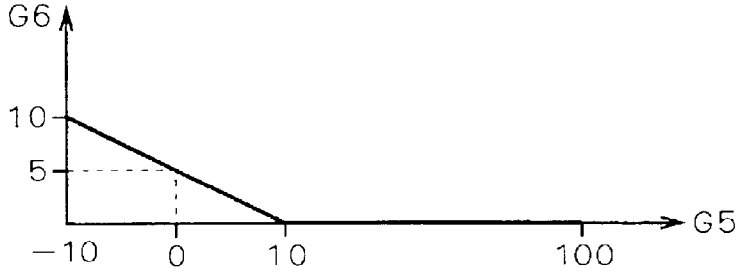
Figure 12C:
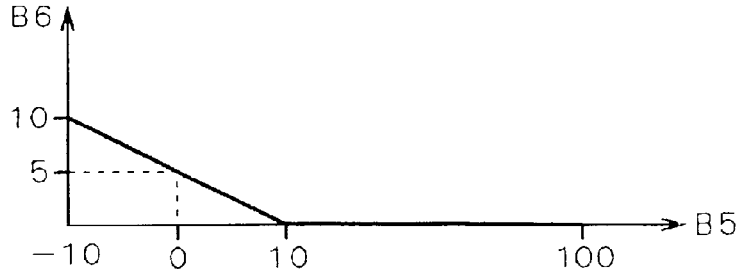

FIGS. 12(*a*) to 12(*c*) are graphs showing the relationship between after-subtraction data and addition data. As shown in these figures, the addition data generating means 14 generates addition data R6, G6, and B6 that correspond to the values of after-subtraction data R5, G5, and B5, respectively. For instance, when after-subtraction data R5 is 10 or more, R6 is zero. When after-subtraction data R5 is zero, R6 is five. When after-subtraction data R5 is −10, R6 is 10.

FIG. 13 is an explanatory diagram showing in table the relationship among after-input-processing image data R1, G1, B1, after-black-correction data R2, G2, B2, and tristimulus values X3, Y3, Z3 of color (light) received by the viewer's eyes, in a situation where there is the influence of external light, in the image display device of this preferred embodiment. FIG. 13 shows the instance that the relationship of R1=G1=B1 holds, i.e., an achromatic data is inputted to the black correction means 2B. In FIG. 13, the ratio of Y3 that corresponds to luminance in the tristimulus values of color (light) received by the viewer's eyes when after-black-correction image data R2, G2, and B2 are respectively inputted to the image display means 3, to Y3 (Ymax) when R1=100, G1=100, and B1=100 (when displaying white), is indicated as a ratio to white (Y/Ymax).

In the image display device of the third preferred embodiment, the equivalent display to that in a situation where there is no influence of external light is realized when after-input-processing image data R1, G1, B1 have values larger than twice of black-approximated data R3, G3, B3 (R3=10, G3=10, B3=10). In general, black-approximated data R3, G3, and B3 usually have values as small as one tenth of after-input-processing image data R1, G1, and B1. With the image display device of the third preferred embodiment, the equivalent display to that in a situation where there is no influence of external light is obtainable with respect to a large amount of data, even when there is the influence of external light. This makes possible to provide image having a large contrast and excellent visibility to the viewer.

In the first preferred embodiment, there occurs "black fading" phenomenon that luminance is constant in the region where after-input-processing image data R1, G1, and B1 are not more than black-approximated data R3, G3, and B3. Whereas in the image display device of the third preferred embodiment, the addition data generating means 14 generates addition data R6, G6, and B6 based on image data R1, G1, and B1, thus causing no "black fading." Note that in the image display device of the third preferred embodiment, the range of after-input-processing image data R1, G1, and B1, within which it is capable of realizing the equivalent display to that in a situation where there is no influence of external light, will vary depending on the contents of addition data generated from the addition data generating means 14.

Figure 14:
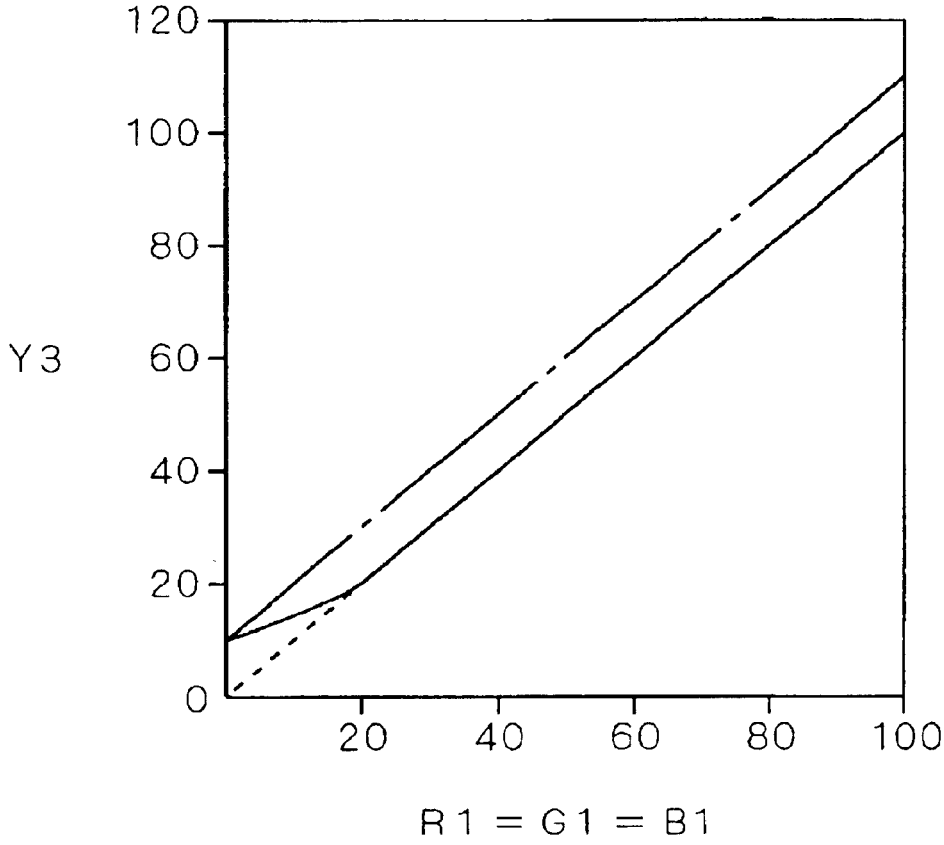
FIG. 14 is a graph showing the relationship between after-input-processing image data and luminance stimulus value.

FIG. 14 is a graph showing the relationship between after-input-processing image data R1, G1, B1, and a luminance stimulus value Y3. In FIG. 14, a continuous line represents the image display device of the third preferred embodiment of the present invention when there is the influence of external light; an alternate long and short dash line represents a conventional image display device when there is the influence of external light; and a dotted line represents the case where there is no influence of external light.

In the third preferred embodiment, when there is the influence of external light, the values of black-approximated data are set so as to perform the equivalent display to that in a situation where there is no influence of external light. By applying the concept of the second preferred embodiment, the values of black-approximated data can be set so as to perform the equivalent display to that in a situation where the tristimulus values in displaying black are zero, even when the tristimulus values in displaying black have large values due to the characteristics of the image display means, in addition to the influence of external light.

4. Fourth Preferred Embodiment

Figure 15:
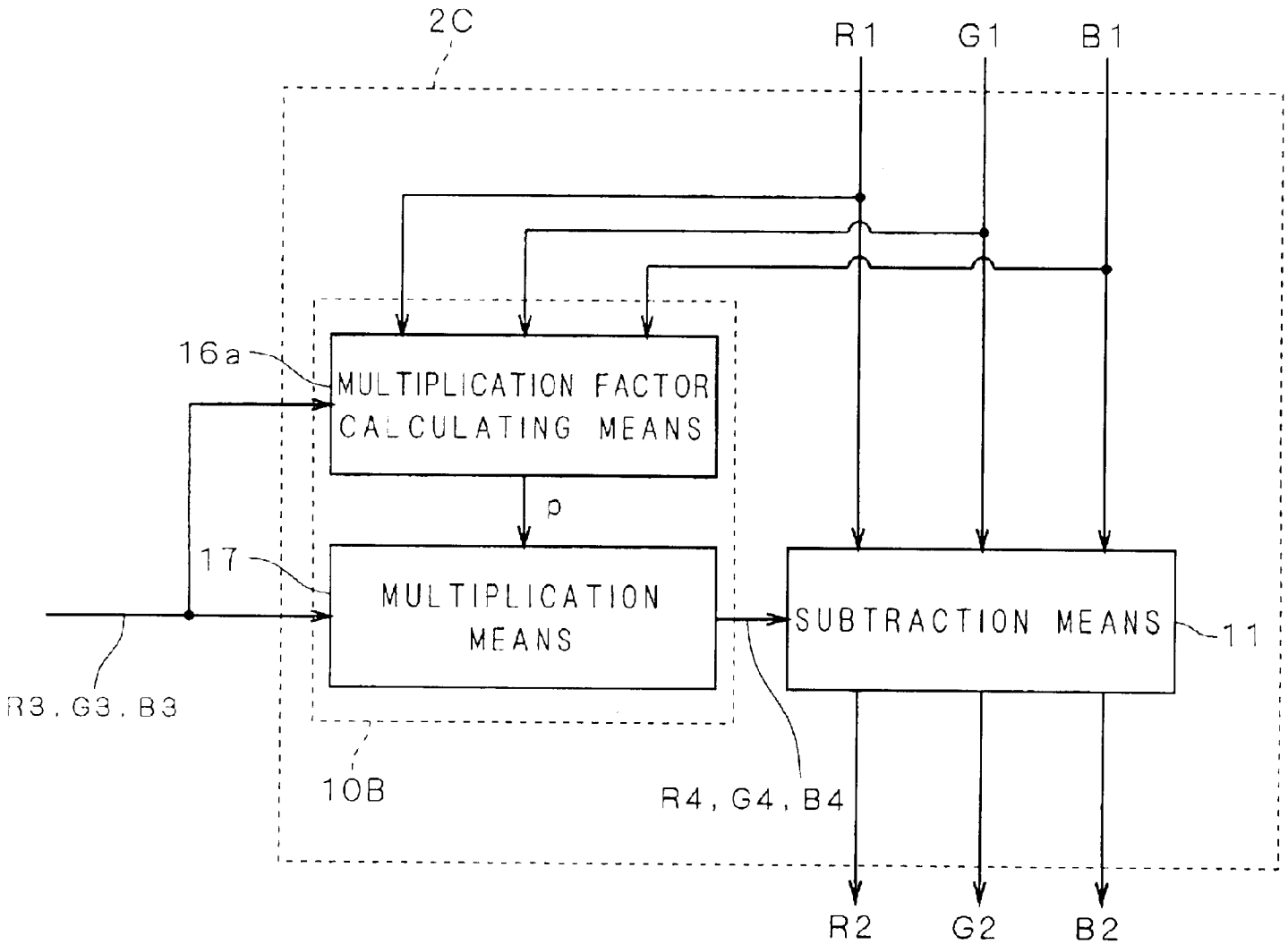
FIG. 15 is a block diagram showing the configuration of a black correction means in an image display device according to a fourth preferred embodiment of the invention.

FIG. 15 is a block diagram showing an example of the configuration of a black correction means in an image display device according to a fourth preferred embodiment of the invention. As shown in FIG. 15, a black correction means 2C of the fourth preferred embodiment is configured with a subtraction data calculating means 10B (multiplication factor calculating means 16*a*, and multiplication means 17), and subtraction means 11. The subtraction means 11 is the same as that of the first preferred embodiment shown in FIG. 2. The overall configuration is the same as that of the first preferred embodiment shown in FIG. 1, except that the black correction means 2A is replaced with the black correction means 2C.

As in the case with the first preferred embodiment, black-approximated data R3, G3, and B3 inputted to the black correction means 2C are inputted to the subtraction data calculating means 10B, and subtraction data R4, G4, and B4 are calculated in the subtraction data calculating means 10B.

The subtraction data calculating means 10B is configured with the multiplication means 17 and multiplication factor calculating means 16*a*. The multiplication factor calculating means 16*a* inputs the after-input-processing image data R1, G1, B1, and black-approximated data R3, G3, B3, then calculates and outputs a multiplication factor p, based on these data.

The multiplication means 17 inputs the multiplication factor p outputted from the multiplication factor calculating means 16*a*, and the black-approximated data R3, G3, B3, then performs multiplication processing expressed in the following equation (25), to calculate subtraction data R4, G4, B4. The multiplication means 17 may be configured with hardware such as existing multiplier, or configured with software.

$$R4=p\cdot R3G4=p\cdot G3B4=p\cdot B3 \quad (25)$$

The subtraction means 11 inputs the after-input-processing data R1, G1, B1, and the subtraction data R4, G4, B4, then performs subtraction processing expressed in the following equation (26), to calculate and output after-black-correction data R2, G2, B2.

$$R2=R1-R4G2=G1-G4B2=B1-B4 \quad (26)$$

Figure 16:
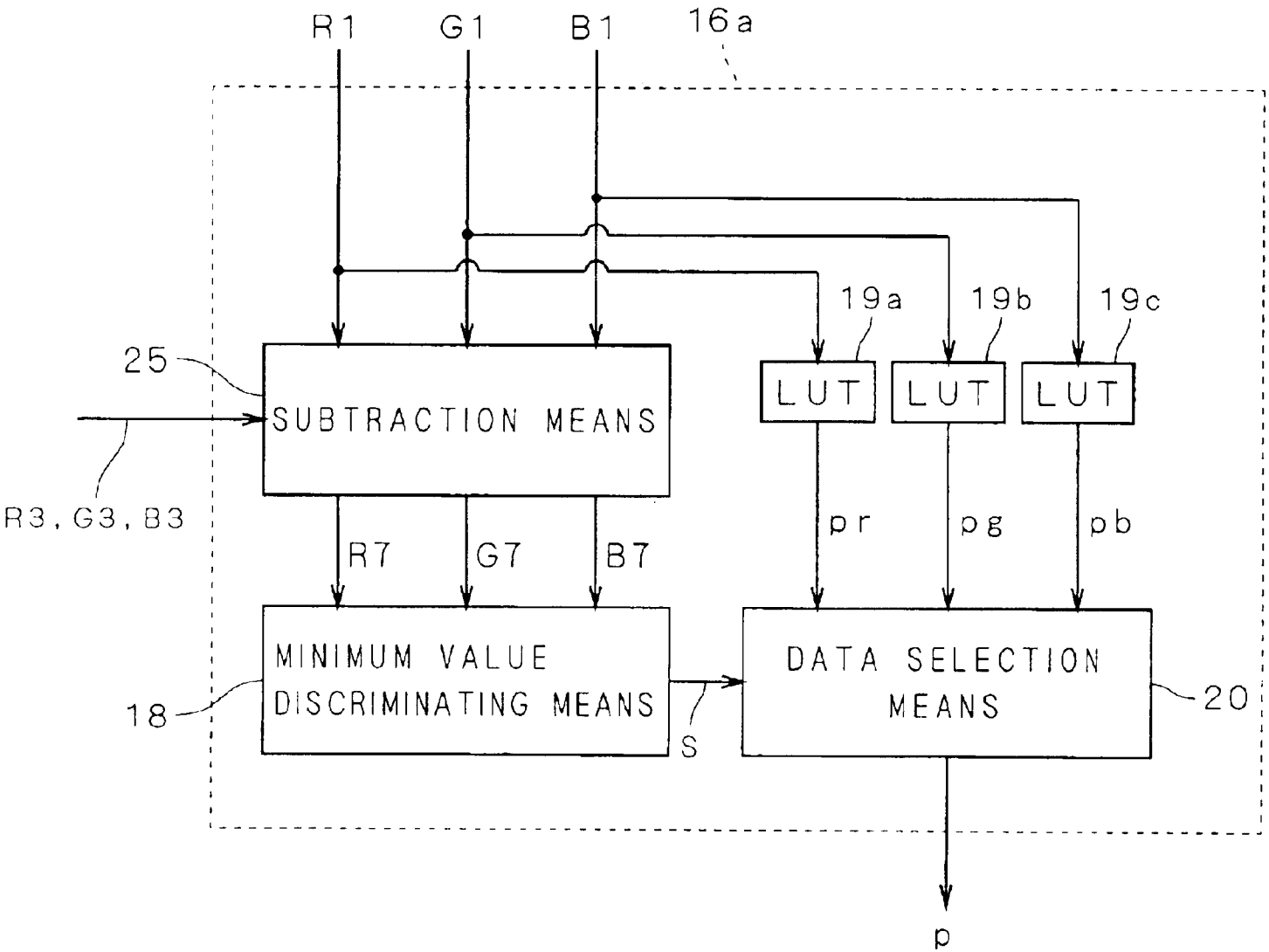
FIG. 16 is a block diagram showing an example of the internal configuration of a multiplication factor calculating means.

FIG. 16 is a block diagram showing an example of the internal configuration of the multiplication factor calculating means 16*a*. As shown in FIG. 16, the multiplication factor calculating means 16*a* is configured with a minimum value discriminating means 18, look-up tables 19*a* to 19*c*, data selection means 20, and subtraction means 25.

The after-input-processing image data R1, G1, B1, and the black-approximated data R3, G3, B3, are inputted to the subtraction means 25. The subtraction means 25 performs subtraction processing expressed in the following equation (27), to calculate after-subtraction data R7, G7, B7. Like the subtraction means 11, the subtraction means 25 may be configured with hardware or software.

$$R7=R1-R3G7=G1-G3B7=B1-B3 \quad (27)$$

The after-subtraction data R7, G7, and B7 outputted from the subtraction means 25 are inputted to the minimum value discriminating means 18. The minimum value discriminating means 18 discriminates which value of the after-subtraction data R7, G7, and B7 is the minimum, and outputs its discrimination result as a selection signal S. The minimum value discriminating means 18 may be realized with hardware or software.

On the other hand, the after-input-processing image data R1, G1, and B1 are also inputted to the look-up tables (LUT) 19*a*, 19*b*, and 19*c*, respectively.

In the look-up table 19*a*, the corresponding multiplication factor is previously stored by using the after-input-processing image data R1 as address. Therefore, the look-up table 19*a* outputs a multiplication factor pr (<1) that corresponds to the value of the after-input-processing image data R1. This is true for the look-up tables 19*b* and 19*c*. A multiplication factor pg (<1) that corresponds to the value of the image data G1 is outputted from the look-up table 19*b*, and a multiplication factor pb (<1) that corresponds to the value of the image data B1 is outputted from the look-up table 19*c*.

The multiplication factors pr, pg, and pb outputted from the look-up tables 19*a*, 19*b*, and 19*c*, are inputted to the data selection means 20. The selection signal S from the minimum value discriminating means 18 is also inputted to the data selection means 20.

According to the contents of the selection signal S, the data selection means 20 selects and outputs a multiplication factor p from the multiplication factors pr, pg, and pb that are candidates for the multiplication factor p. Note that the data selection means 20 may be realized with hardware or software.

The multiplication factor calculating means 16*a* in the fourth preferred embodiment calculates and outputs the multiplication factor p, through the foregoing operations.

One example of the multiplication factors pr, pg, and pb to be stored in the look-up tables 19*a*, 19*b*, and 19*c* will be discussed here. In the image display device of the fourth preferred embodiment, the subtraction means 11 calculates after-black-correction data R2, G2, and B2 by subtracting the subtraction data R4, G4, and B4 from the after-input-processing image data R1, G1, and B1, in the same manner as described above. Theoretically, the subtraction data R4, G4, and B4 should be equal to the black-approximated data R3, G3, and B3.

However, the black-approximated data R3, G3, and B3 are data related to luminance, chromaticity, or tristimulus value in displaying black on the image display means 3, and will not vary depending on the values of the after-input-processing image data R1, G1, and B1. Accordingly, if the subtraction data R4, G4, and B4 are equal to the black-approximated data R3, G3, and B3, a negative value occurs in the after-black-correction data when the values of the after-input-processing image data R1, G1, and B1 are smaller than the values of the black-approximated data R3, G3, and B3. Therefore, when the after-input-processing image data R1, G1, and B1 have small values, multiplication factors pr, pg, and pb, each being smaller than 1, are generated and multiplied by black-approximated data R3, G3, and B3, thereby obtaining subtraction data R4, G4, and B4. This reliably prevents that any negative value occurs in the after-black-correction data R2, G2, and B2.

Figure 17:
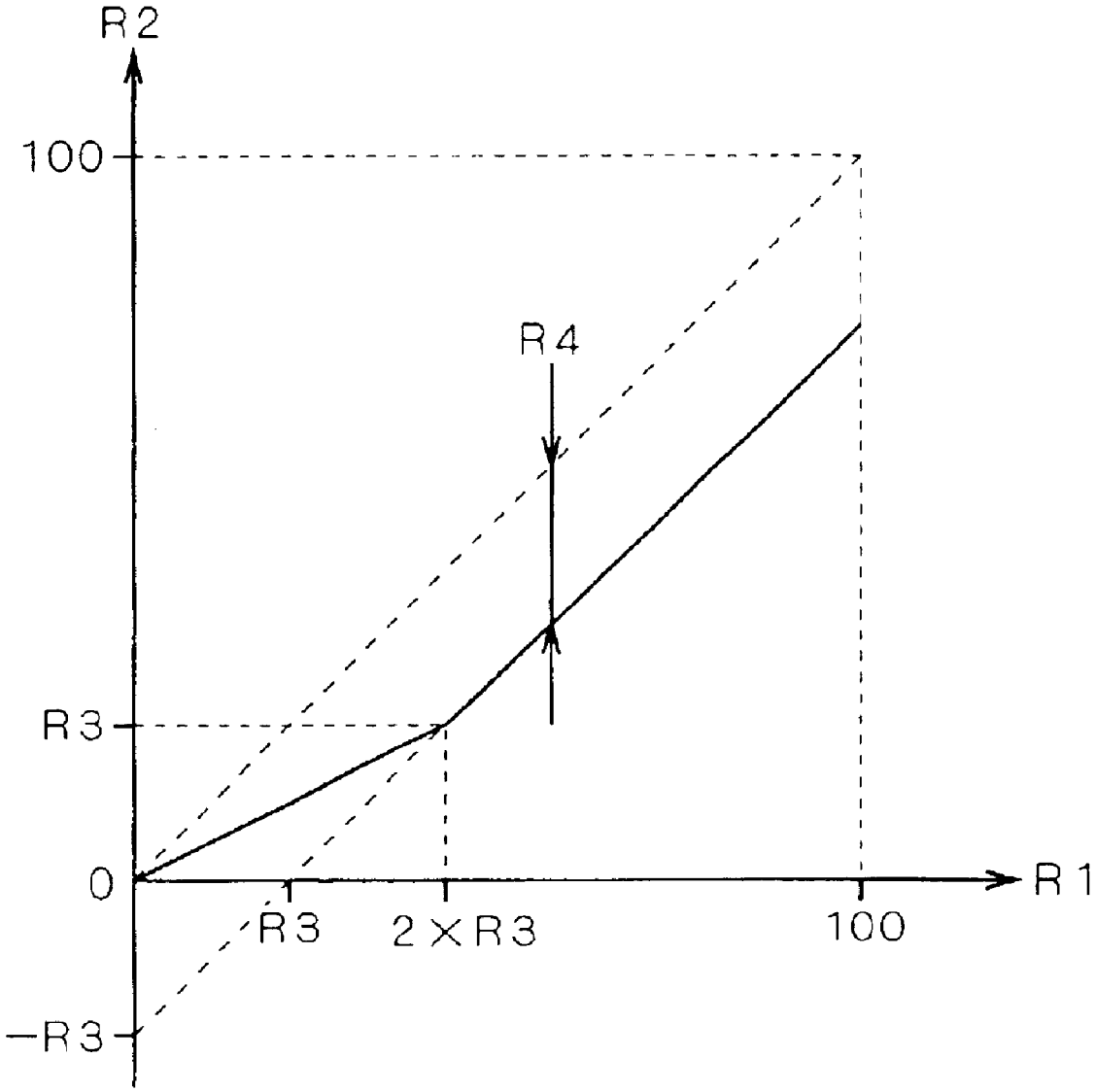
FIG. 17 is a graph showing an example of the relationship between after-input-processing image data and after-black-correction data.

FIG. 17 is a graph showing an example of the relationship between after-input-processing image data and after-black-correction data. Consider now the case of storing, in the look-up table 19*a*, such a multiplication factor pr with which the after-input-processing image data R1 and after-black-correction data R2 are in the relationship as shown in FIG. 17. Here, R2 can be expressed in the following equation (28):

$$R2 = R1 - R3 \quad \text{when } R1 \geq 2\cdot R3 \quad (28)$$

$$R2 = \frac{R1}{2} \quad \text{when } R1 < 2\cdot R3$$

Since the subtraction data R4 is a difference between the after-black-correction data R2 and after-input-processing image data R1, it can be expressed in the following equation (29):

$$R4 = R3 \quad \text{when } R1 \geq 2\cdot R3 \quad (29)$$

$$R4 = \frac{R1}{2} \quad \text{when } R1 < 2\cdot R3$$

The multiplication factor pr is a ratio of subtraction data R4 to black-approximated data R3, and can be found from the following equation (30). Although the multiplication factor pr is discussed above, the same is true for the multiplication factors pg and pb.

$$pr = 1 \quad \text{when } R1 \geq 2\cdot R3 \quad (30)$$

$$pr = \frac{R1}{2\cdot R3} \quad \text{when } R1 < 2\cdot R3$$

Further in the fourth preferred embodiment, it is configured that the minimum value discriminating means 18 discriminates the minimum value of the after-subtraction data R7, G7, and B7, which are obtained by subtracting the black-approximated data R3, G3, B3 from the after-input-processing image data R1, G1, B1. Then, the data selection means 2 selects a multiplication factor p, based on the discrimination result of the minimum value discriminating means 18. Thus, the minimum value in the multiplication factors pr, pg, and pb can be selected as a multiplication factor p, by using the minimum-value discrimination result with respect to the after-subtraction data R7, G7, and B7. Selecting, as multiplication factor p, the minimum value from the multiplication factors pr, pg, and pb reliably prevents that any negative value occurs in the after-black-correction data R2, G2, and B2.

FIG. 18 is an explanatory diagram showing in table the relationship among after-input-processing image data R1, G1, B1, after-black-correction data R2, G2, B2, and tristimulus values X3, Y3, Z3 of color (light) received by the viewer's eyes, in a situation where there is the influence of external light, in the image display device of the fourth preferred embodiment. Specifically, FIG. 18 shows the instance that the relationship of R1=G1=B1 holds, i.e., an achromatic data is inputted to the black correction means 2C.

In FIG. 18, the ratio of Y3 that corresponds to luminance in the tristimulus values of color (light) received by the viewer's eyes when each of R2, G2, and B2 is inputted to the image display means 3, to Y3 (Ymax) when R1=100, G1=100, and B1=100 (when displaying white), is indicated as a ratio to white (Y/Ymax).

Here, as in the first preferred embodiment, suppose that the tristimulus values of a reflected light of external light on the surface of a predetermined screen of the image display means 3 are X3=9.505, Y3=10, and Z3=10.89. Then, the black-approximated data can be expressed in R3=10, G3=10, and B3=10.

In the image display device of the fourth preferred embodiment, the equivalent display to that in a situation where there is no influence of external light is realized when after-input-processing image data R1, G1, B1 have values larger than twice of black-approximated data R3, G3, B3 (R3=10, G3=10, B3=10). In general, black-approximated data R3, G3, and B3 usually have values as small as one tenth of after-input-processing image data R1, G1, and B1. With the image display device of the fourth preferred embodiment, the equivalent display to that in a situation where there is no influence of external light is obtainable with respect to a large amount of data, even when there is the influence of external. This makes possible to provide image having a large contrast and excellent visibility to the viewer.

In the first preferred embodiment, there occurs "black fading" phenomenon that luminance is constant in the region where after-input-processing image data R1, G1, and B1 are not more than black-approximated data R3, G3, and B3. Whereas in the image display device of the fourth preferred embodiment, the subtraction data calculating means 10B calculates subtraction data R4, G4, and B4 based on the image data R1, G1, and B1, thus causing no "black fading." Note that in the image display device of the fourth preferred embodiment, the range of after-input-processing image data R1, G1, and B, within which it is capable of realizing the equivalent display to that in a situation where there is no influence of external light, will vary depending on the contents of multiplication factors pr, pg, and pb that are stored in the look-up tables 19*a*, 19*b*, and 19*c*.

Figure 19:
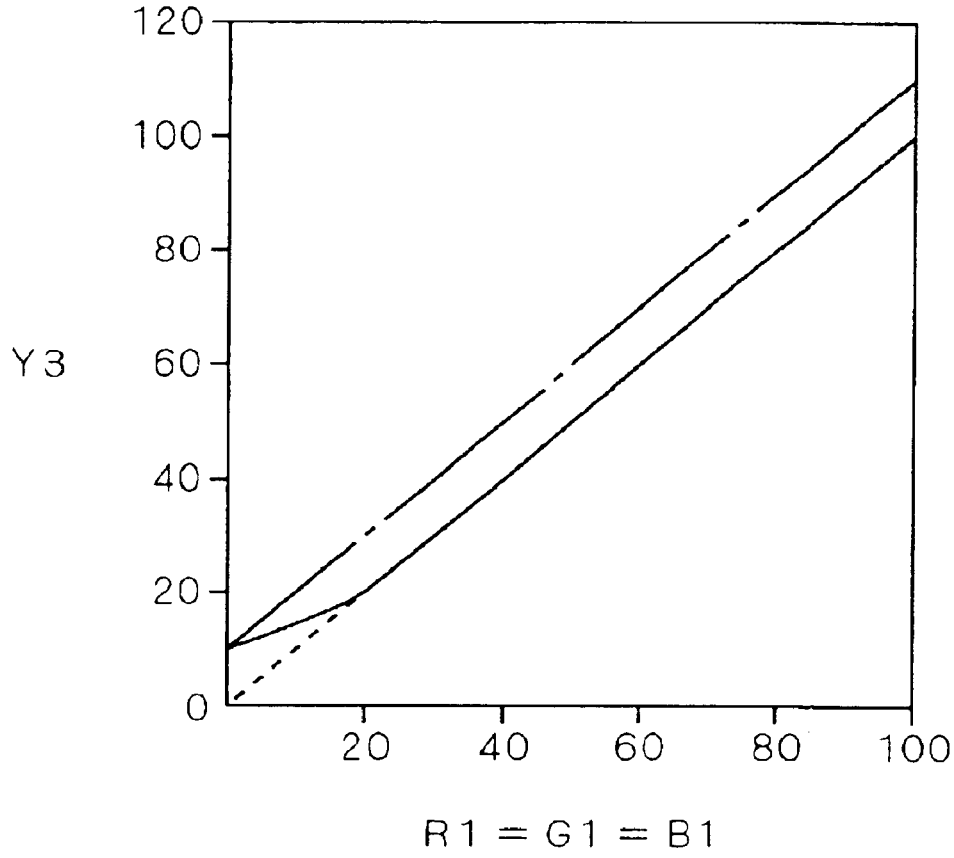
FIG. 19 is a graph showing the relationship between after-input-processing image data and luminance stimulus value.

FIG. 19 is a graph showing the relationship between after-input-processing image data R1, G1, B1, and a luminance stimulus value Y3. In FIG. 19, a continuous line represents the image display device of the fourth preferred embodiment of the present invention when there is the influence of external light; an alternate long and short dash line represents a conventional image display device when there is the influence of external light; and a dotted line represents the case where there is no influence of external light.

In the fourth preferred embodiment, when there is the influence of external light, the values of black-approximated data are set so as to perform the equivalent display to that in a situation where there is no influence of external light. By applying the concept of the second preferred embodiment, the values of black-approximated data can be set so as to perform the equivalent display to that in a situation where the tristimulus values in displaying black are zero, even when the tristimulus values in displaying black have large values due to the characteristics of the image display means, in addition to the influence of external light.

5. Fifth Preferred Embodiment

Figure 20:
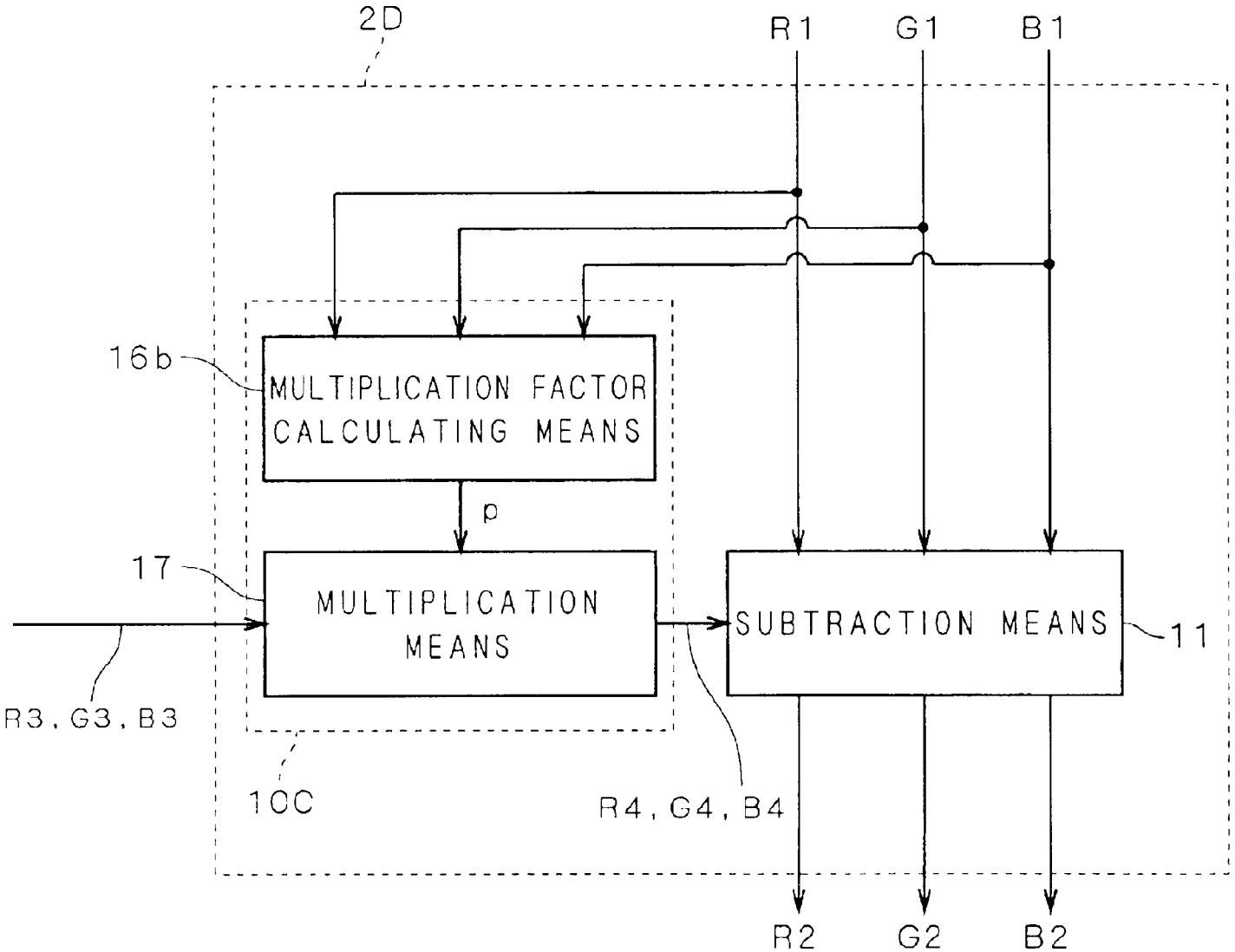
FIG. 20 is a block diagram showing an example of the configuration of a black correction means in an image display device according to a fifth preferred embodiment of the invention.

FIG. 20 is a block diagram showing an example of the configuration of a black correction means in an image display device according to a fifth preferred embodiment of the invention. As shown in FIG. 20, a black correction means 2D is configured with a subtraction data calculating means 10C (multiplication factor calculating means 16*b*, and multiplication means 17), and subtraction means 11. In FIG. 20, the subtraction means 11 and multiplication means 17 are the same as in the fourth preferred embodiment shown in FIG. 15, and the overall configuration is the same as that of the first preferred embodiment shown in FIG. 1, except that the black correction means 2A is replaced with the black correction means 2D.

As in the case with the fourth preferred embodiment, black-approximated data R3, G3, and B3 inputted to the black correction means 2D, are inputted to the subtraction data calculating means 10C, then subtraction data R4, G4, and B4 are calculated in the subtraction data calculating means 10C. The subtraction data calculating means 10C is configured with the multiplication means 17 and multiplication factor calculating means 16*b*. The multiplication factor calculating mean 16*b* inputs the after-input-processing image data R1, G1, and B1, then calculates a multiplication factor p.

The multiplication means 17 inputs the multiplication factor p outputted from the multiplication factor calculating means 16*b*, and the black-approximated data R3, G3, B3, then performs multiplication processing to calculate subtraction data R4, G4, B4. The subtraction means 11 inputs the after-input-processing data R1, G1, B1, and the subtraction data R4, G4, B4, then performs subtraction processing to calculate and output after-black-correction data R2, G2, B2. The processing in the subtraction means 11 and multiplication means 17 are the same as in the fourth preferred embodiment.

Figure 21:
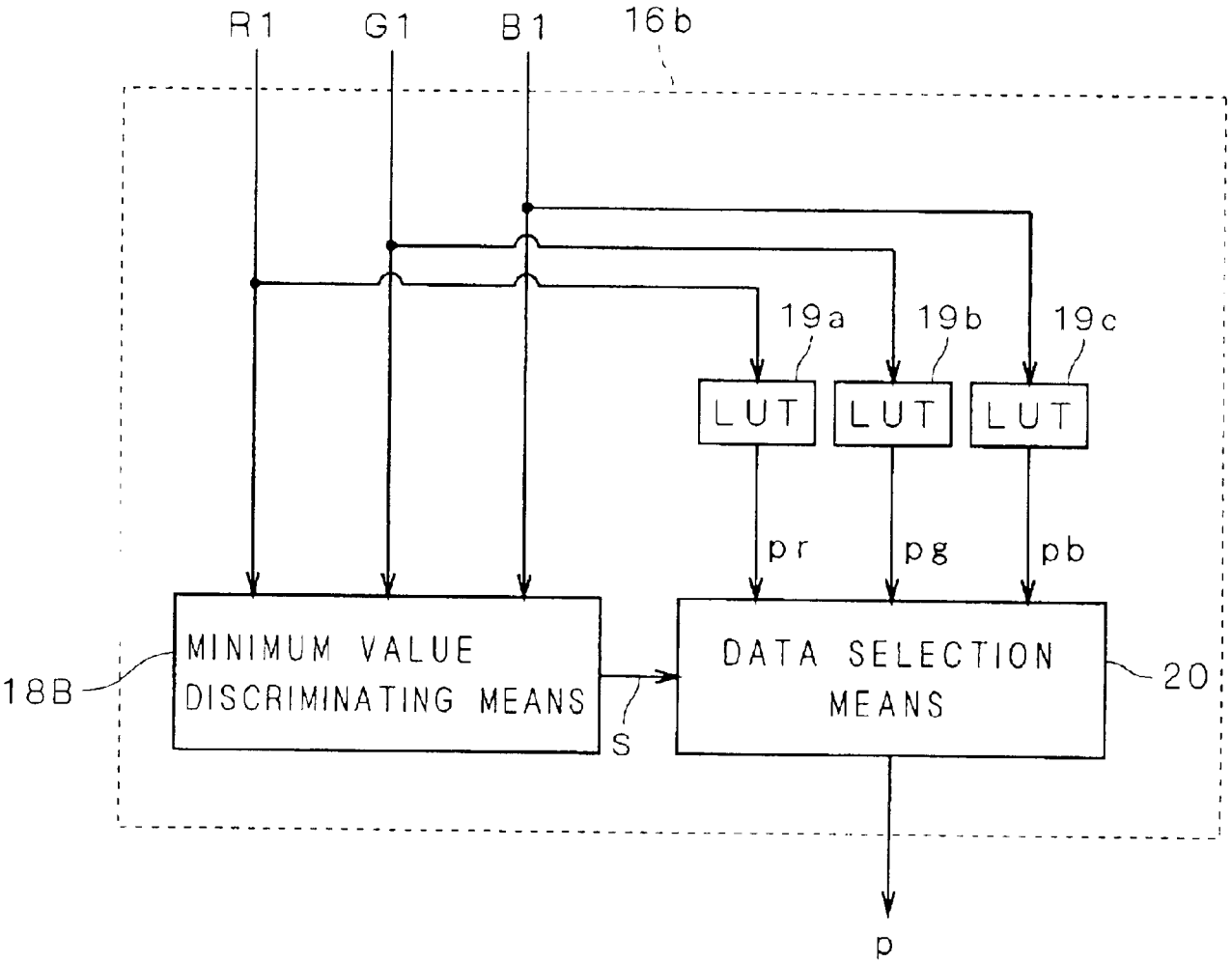
FIG. 21 is a block diagram showing an example of the configuration of a multiplication factor calculating means shown in FIG. 20.

FIG. 21 is a block diagram showing an example of the configuration of the multiplication factor calculating means shown in FIG. 20. As shown in FIG. 21, the multiplication factor calculating means 16*b* is configured with a minimum value discriminating means 18B, look-up tables 19*a* to 19*c*, and data selection means 20. The look-up tables 19*a* to 19*c* and data selection means 20 are the same as in the fourth preferred embodiment shown in FIG. 16.

In the fourth preferred embodiment, it is so configured that a difference between the after-input-processing image data R1, G1, B1, and black-approximated data R3, G3, is inputted to the minimum value discriminating means 18, then a multiplication factor is selected from the multiplication factors pr, pg, and pb, based on the minimum value discrimination result.

On the other hand, the minimum value discriminating means 18B of the multiplication factor calculating means 16*b* in the fifth preferred embodiment inputs after-input-processing image data R1, G1, B1, and outputs, based on the minimum value discrimination result, a selection signal S that selects a multiplication factor p from multiplication factors pr, pg, and pb. Note that the minimum value discriminating means 18B may be configured with hardware or software. Also, note that the configuration except for the multiplication factor calculating means 16B is the same as that of the fourth preferred embodiment shown in FIG. 16, and detail description is omitted.

With the use of the multiplication factor calculating means 16*b* in the fifth preferred embodiment, there occurs no large variations in black-approximated data R3, G3, and B3. Therefore, as in the multiplication factor calculating means 16*a* of the fourth preferred embodiment, it is possible to prevent that any negative value occurs in after-black-correction data R2, G2, and B2.

Thus, with the image display device of the fifth preferred embodiment of the invention, the equivalent display to that in a situation where there is no influence of external light is obtainable with respect to a large amount of data, even when there is the influence of external light. This makes possible to provide image having a large contrast and excellent visibility to the viewer. In the first preferred embodiment, there occurs "black fading" phenomenon that luminance is constant in the region where after-input-processing image data R1, G1, and B1 are not more than black-approximated data R3, G3, and B3. Whereas in the image display device of the fifth preferred embodiment, "black fading" can be suppressed by allowing the look-up tables to store suitable multiplication factors.

Furthermore in the fifth preferred embodiment, by setting black-approximated data by applying the concept of the second preferred embodiment, the equivalent display to that in a situation where the tristimulus values in displaying black are zero, is obtainable even when the tristimulus values in displaying black have large values due to the characteristics of the image display means, in addition to the influence of external light.

6. Sixth Preferred Embodiment

Figure 22:
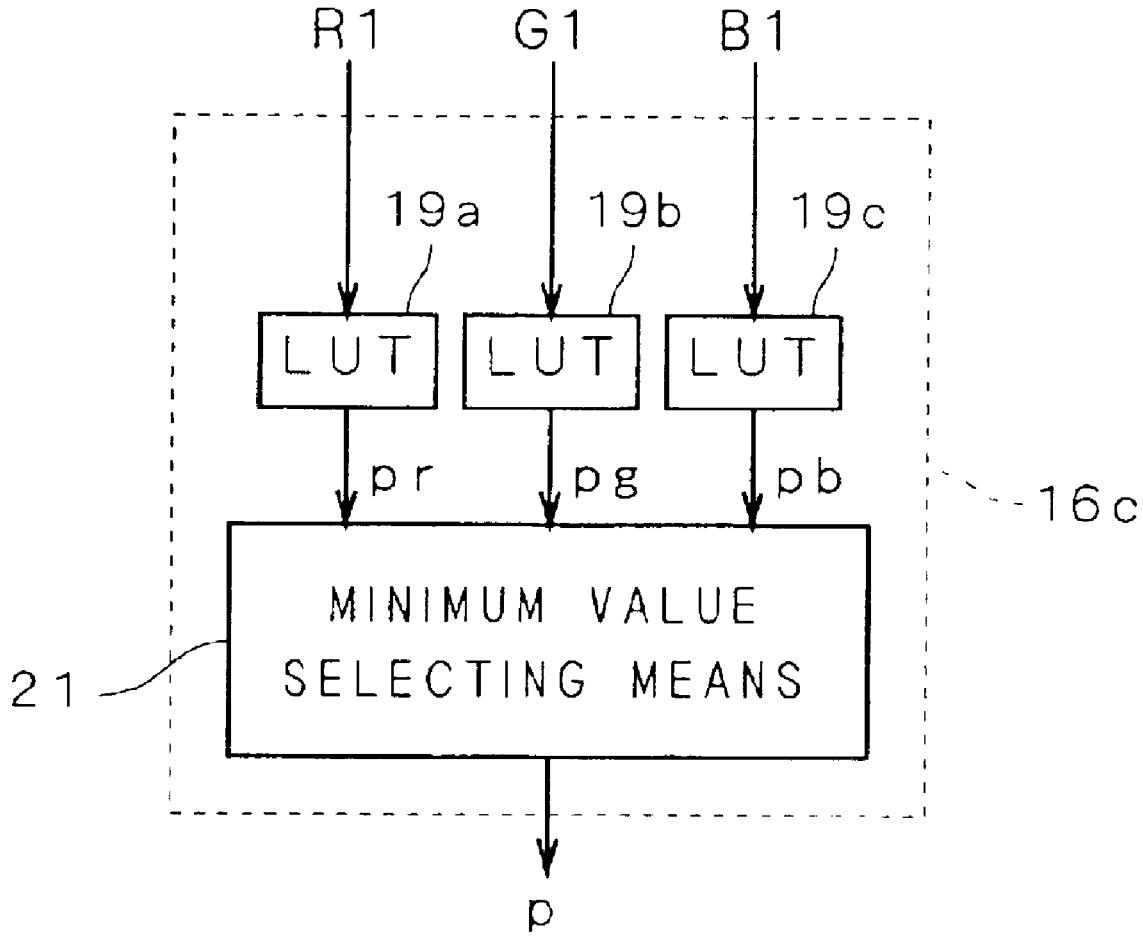
FIG. 22 is a block diagram showing an example of the configuration of a multiplication factor calculating means in an image display device according to a sixth preferred embodiment of the invention.

FIG. 22 is a block diagram showing an example of the configuration of a multiplication factor calculating means in an image display device according to a sixth preferred embodiment of the invention. As shown in FIG. 22, a multiplication factor calculating means 16*c* is configured with look-up tables 19*a* to 19*c*, and minimum value selection means 21. The look-up tables 19*a* to 19*c* are the same as in the fourth and fifth preferred embodiments shown in FIGS. 16 and 21, respectively. The internal configuration of a black correction means 2D is the same as in the fifth preferred embodiment shown in FIG. 20, except that the multiplication factor calculating means 16*b* is replaced with the multiplication factor calculating means 16*c*. The overall configuration is the same as that of the first preferred embodiment shown in FIG. 1, except that the black correction means 2A is replaced with the black correction means 2D.

Referring to FIG. 22, after-input-processing image data R1, G1, and B1 are inputted to the look-up tables 19*a*, 19*b*, and 19*c*. Processing of outputting multiplication factors pr, pg, and pb that correspond to the after-input-processing image data R1, G1, and B1, is the same as that of the fifth preferred embodiment. The multiplication factors pr, pg, and pb outputted from the look-up tables 19*a*, 19*b*, and 19*c*, are inputted to the minimum value selection means 21. The minimum value selection means 21 outputs, as a multiplication factor p, the minimum value among the multiplication factors pr, pg, and pb. Note that the minimum value selection means 21 may be configured with hardware or software.

In the multiplication factor calculating means 16*c* of the sixth preferred embodiment, the minimum value among the multiplication factors pr, pg, and pb is outputted as a multiplication factor p. It is therefore possible to prevent that any negative value occurs in after-black-correction data R2, G2, and B2. Thus, with the image display device of this invention, the equivalent display to that in a situation where there is no influence of external light is obtainable with respect to a large amount of data, even when there is the influence of external light. This makes possible to provide image having a large contrast and excellent visibility to the viewer.

In the image display device of the first preferred embodiment, there occurs "black fading" phenomenon that luminance is constant in the region where after-input-processing image data R1, G1, and B1 are not more than black-approximated data R3, G3, and B3. Whereas in the image display device of the sixth preferred embodiment, "black fading" can be suppressed by allowing the look-up tables to store suitable multiplication factors.

Furthermore in the sixth preferred embodiment, by setting black-approximated data by applying the concept of the second preferred embodiment, the equivalent display to that in a situation where the tristimulus values in displaying black are zero, is obtainable even when the tristimulus values in displaying black have large values due to the characteristics of the image display means, in addition to the influence of external light.

7. Seventh Preferred Embodiment

Figure 23:
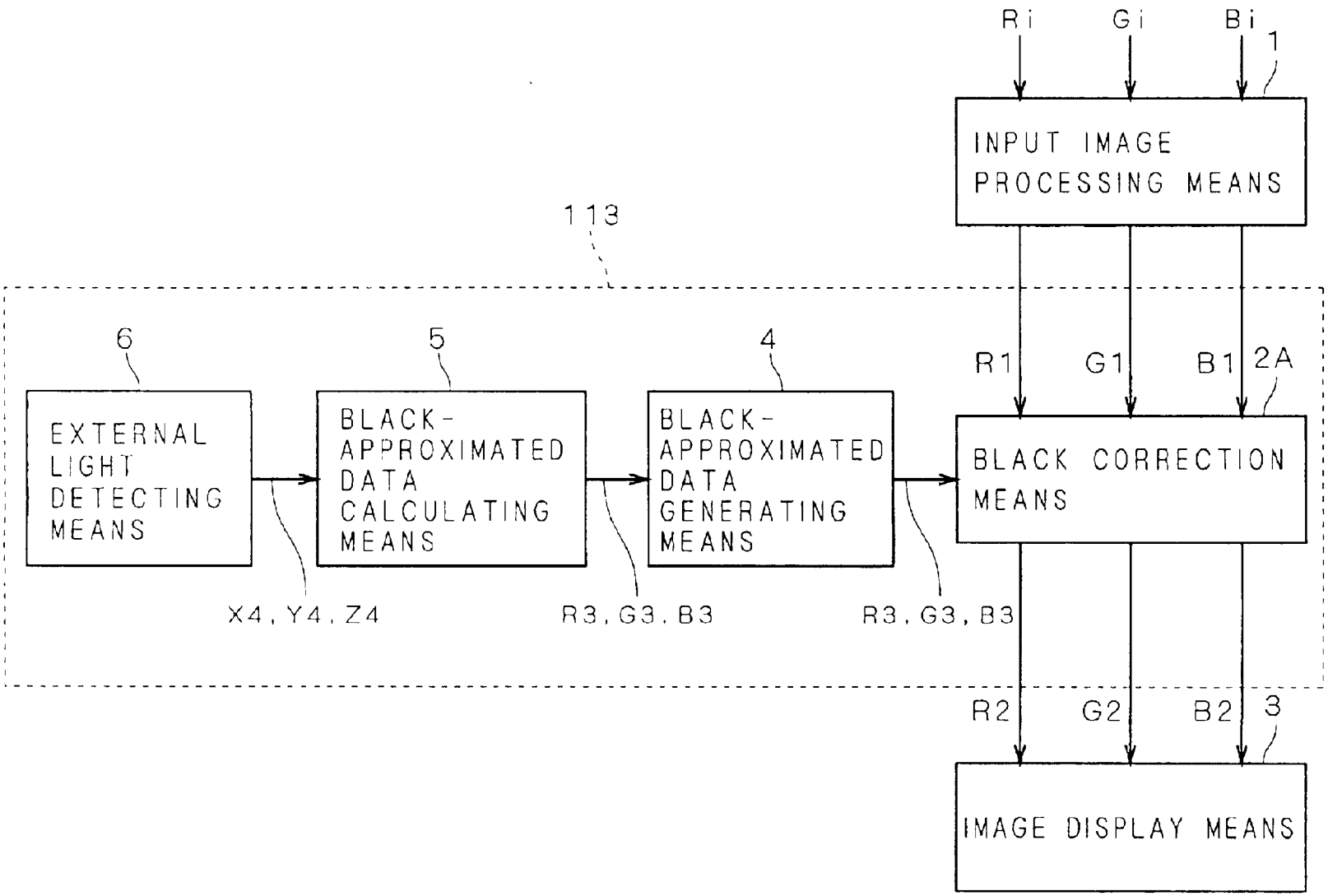
FIG. 23 is a block diagram showing an example of the configuration of an image display device according to a seventh preferred embodiment of the invention.

FIG. 23 is a block diagram showing an example of the configuration of an image display device according to a seventh preferred embodiment of the invention. As shown in FIG. 23, an input image processing means 1, black correction means 2A, image display means 3, and black-approximated data generating means 4 are the same as in the first preferred embodiment shown in FIG. 1. This embodiment differs from the first preferred embodiment in the point that a black approximated data calculating means 5 and external-light detecting means 6 are added. That is, a black correction part 113 is made up of the black correction means 2A, black-approximated data generating means 4, black-approximated data calculating means 5, and external-light detecting means 6.

The external-light detecting means 6 detects tristimulus values X4, Y4, and Z4 of external light irradiating the surface of a predetermined screen of the image display means 3, and outputs these values as external-light detection data to the black-approximated data calculating means 5.

The black-approximated data calculating means 5 inputs the external-light tristimulus values X4, Y4, and Z4 outputted from the external-light detecting means 6, and calculates black-approximated data R3, G3, and B3, then sets the calculated black-approximated data R3, G3, and B3 to the black-approximated data generating means 4.

On the other hand, image data Ri, Gi, and Bi that are composed of three color data inputted to the image display device are inputted to the input image processing means 1. The input image processing means 1 subjects the inputted image data Ri, Gi, and Bi to input image processing, and outputs after-input-processing image data R1, G1, and B1 composed of three color data. Examples of the input image processing are gradation correction processing, pixel number transformation processing, and color transformation processing, in response to the characteristics of image data inputted. The black-approximated data generating means 4 holds the black-approximated data R3, G3, and B3 set by the black-approximated data calculating means 5, then generates and provides these black-approximated data R3, G3, and B3 to the black correction means 2A.

The black correction means 2A inputs the after-input-processing image data R1, G1, B1, and the black-approximated data R3, G3, B3, then calculates and outputs after-black-correction data R2, G2, B2. The after-black-correction data R2, G2, and B2 outputted from the black-correction means 2A are sent to the image display means 3. On the image display means 3, in response to the value of the after-black-correction image data R2, G2, B3, each pixel emits for image display. As an example of the image display means, there is a liquid crystal panel or CRT. Since the processing of calculating after-black-correction data R2, G2, B2 in the black correction means 2A is the same as in the first preferred embodiment, its detail description is omitted. Note that the black correction means 2A can be realized with any configuration shown in the second to sixth preferred embodiments.

The processing of calculating black-approximated data R3, G3, and B3 from external-light tristimulus values X4, Y4, and Z4 in the black-approximated data calculating means 5 will be discussed here. In the black-approximated data calculating means 5, first, tristimulus values X2, Y2, and Z2 of a reflected light of external light on the surface of a predetermined screen of the image display means 3 are calculated from the external-light tristimulus values X4, Y4, and Z4. The tristimulus values X2, Y2, and Z2 of the reflected light of external light can be calculated with information such as reflectance and spectral reflectance characteristics on the surface of a predetermined screen of the image display means 3. Supposing, for example, that the reflectance of the predetermined screen of the image display means 3 is al and all wavelength lights are uniformly reflected, tristimulus values X2, Y2, Z2 of the reflected light of external light can be calculated from the following equation (31):

$$X2=a1\cdot X4Y2=a1\cdot Y4Z2=a1\cdot Z4 \tag{31}$$

Then, from the calculated tristimulus values X2, Y2, and Z2 of the reflected light of external light, black-approximated data R3, G3, and B3 are calculated. The method of calculating black-approximated data R3, G3, and B3 from the tristimulus values X2, Y2, and Z2 of the reflected light of external light is already described in the first preferred embodiment.

In the image display device of the seventh preferred embodiment, tristimulus values of external light irradiating the surface of the image display means are detected in the external-light detecting means 6, and black-approximated data are calculated from the detection result. Therefore, suitable black-approximate data are automatically set in accordance with the environment where the image display device is used, without previously setting black-approximated data.

Thus, the equivalent display to that in a situation where there is no influence of external light is obtainable with respect to a large amount of data, even when there is the influence of external light. This makes possible to provide image having a large contrast and excellent visibility to the viewer.

Although the seventh preferred embodiment is directed to the instance that the external-light detecting means 6 detects and outputs tristimulus values of the reflected light, as external-light detection data, the external-light detecting means 6 may detect only the luminance of the reflected light. In this instance, the detected luminance is outputted to the black-approximated data calculating means 5, as external-light detection data. The procedure of calculating black-approximated data only from luminance is already described in the first preferred embodiment.

8. Eighth Preferred Embodiment

Figure 24:
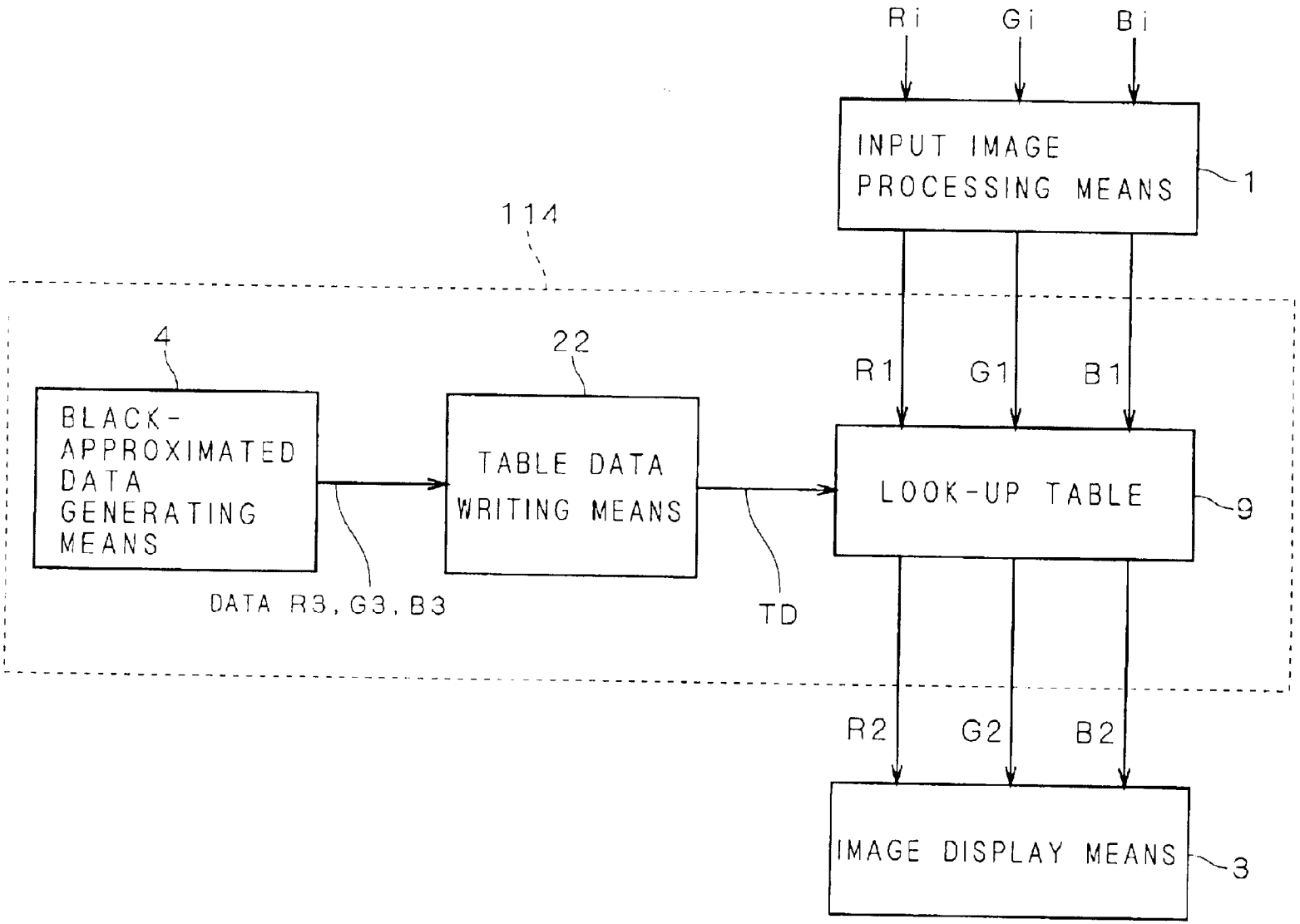
FIG. 24 is a block diagram showing an example of the configuration of an image display device according to an eighth preferred embodiment of the invention.

FIG. 24 is a block diagram showing an example of the configuration of an image display device according to an eighth preferred embodiment of the invention. As shown in FIG. 24, an input image processing means 1, image display means 3, and black-approximated data generating means 4 are the same as in the first preferred embodiment shown in FIG. 1. This embodiment differs from the first preferred embodiment in the point that a look-up table 9 and table data writing means 22 are used in place of the black correction means 2A. That is, a black correction part 114 is made up of the black-approximated data generating means 4, look-up table 9, and table data writing means 22.

In the image display device of the eighth preferred embodiment, the look-up table 9 realizes the processing in the black correction means.

The table data writing means 22 inputs black-approximated data R3, G3, and B3 from the black-approximated data generating means 4 and, by using the black-approximated data R3, G3, and B3, calculates in advance the values of after-black-correction data R2, G2, and B2 (to be outputted from any black-correction means of the first to seventh preferred embodiments), with respect to all combinations of after-input-processing data R1, G1, and B1.

After calculating after-black-correction data R2, G2, and B2, the table data writing means 22 writes, as a table data TD, the values of the calculated after-black-correction data R2, G2, and B2 to the look-up table 9, by using the values of the after-input-processing data R1, G1, and B1, as a write address. As a method of calculating the after-black-correction data R2, G2, and B2 with respect to the after-input-processing image data R1, G1, and B1, any method described in the foregoing preferred embodiments can be used. Note that the table data writing means 22 may be configured with hardware or software.

The calculation of the after-black-correction data R2, G2, and B2 in the look-up table 9 is realized by reading the written table data TD. On the look-up table 9, the after-input-processing image data R1, G1, and B1 from the input-image-processing means 1 are inputted as a read address, and table data R2, G2, and B2 to be stored in the address are outputted as after-black-correction data.

Here, when after-black-correction data R2 is a value that depends only on the after-input-processing image data R1 and will not depend on after-input-processing data G1 and B1, the after-black-correction data R2 can be calculated from a one-dimensional look-up table on which only the after-input-processing image data R1 is used as address. Likewise, when after-black-correction data G2 is a value that depends only on after-input-processing image data G1 and will not depend on after-input-processing data R1 and B1, the after-black-correction data G2 can be calculated from a one-dimensional look-up table on which only the after-input-processing image data G1 is used as address. Also, when after-black-correction data B2 is a value that depends only on after-input-processing image data B1 and will not depend on after-input-processing data R1 and G1, the after-black-correction data B2 can be calculated from a one-dimensional look-up table on which only the after-input-processing image data B1 is used as address.

On the other hand, when each of after-black-correction data R2, G2, and B2 is a value that depends on combinations of after-input-processing image data R1, G1, and B1, the after-black-correction data R2, G2, and B2 can be calculated from a three-dimensional look-up table on which the after-input-processing image data R1, G1, and B1 are used as address.

In the image display device of the eighth preferred embodiment, the look-up table realizes the processing in the black correction means of the first to seventh preferred embodiments, resulting in a simple circuit configuration. This is because the look-up table uses the image data R1, G1, and B1, as address, and it can be realized by memory of the type which reads the values of after-black-correction image data R2, G2, and B2. In addition, the use of the look-up table produces such effects that the table contents can be set freely to increase the degree of freedom, and that the table contents can be rewritten to change the contents of processing.

Further, with the image display device of the eighth preferred embodiment, the equivalent display to that in a situation where there is no influence of external light is obtainable with respect to a large amount of data, even when there is the influence of external light. This makes possible to provide image having a large contrast and excellent visibility to the viewer.

Further in the eighth preferred embodiment, by setting black-approximated data by applying the concept of the second preferred embodiment, the equivalent display to that in a situation where the tristimulus values in displaying black are zero, is obtainable even when the tristimulus values in displaying black have large values due to the characteristics of the image display means, in addition to the influence of external light.

9. Ninth Preferred Embodiment

Figure 25:
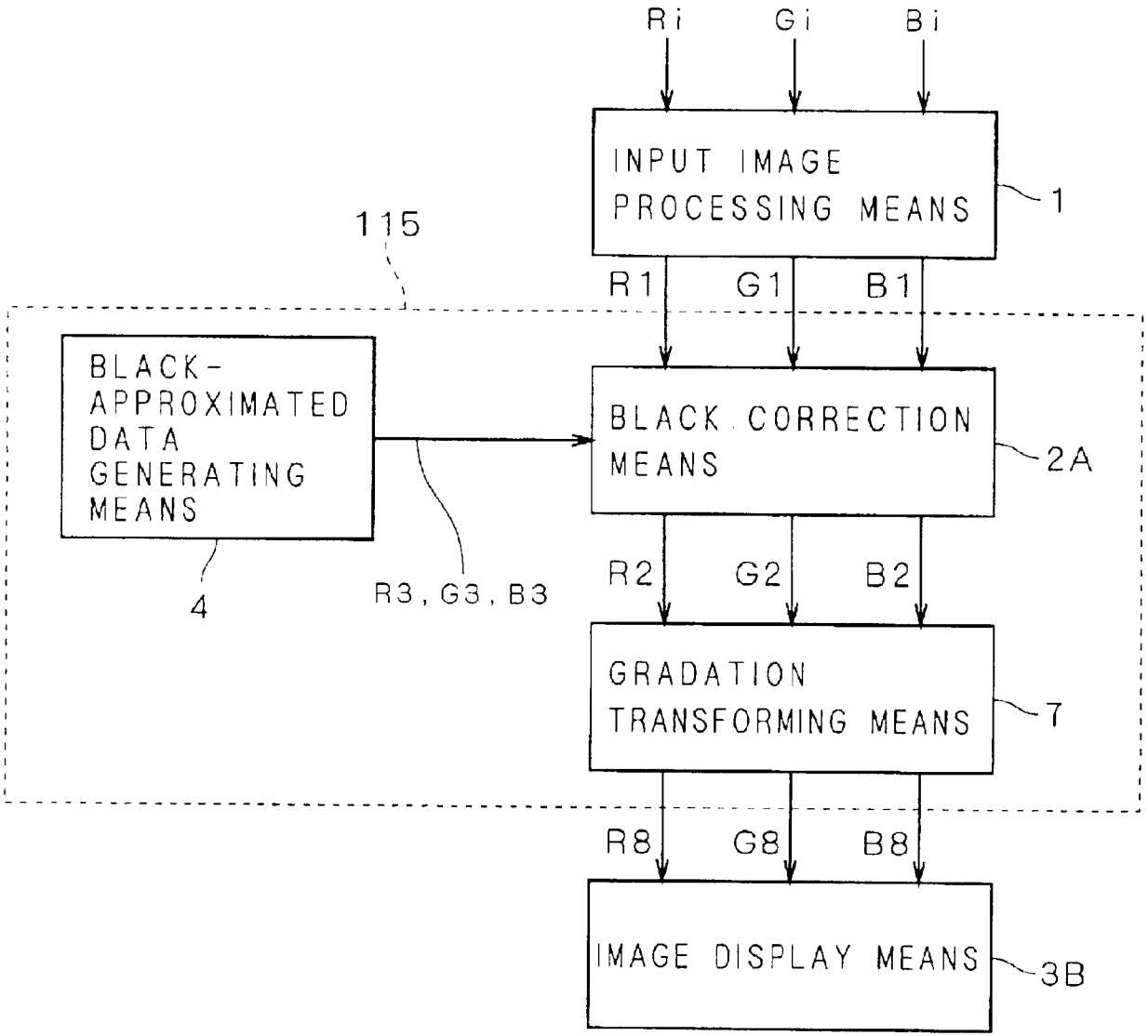
FIG. 25 is a block diagram showing an example of the configuration of an image display device according to a ninth preferred embodiment of the invention.

FIG. 25 is a block diagram showing an example of the configuration of an image display device according to a ninth preferred embodiment of the invention. As shown in FIG. 25, an input image processing means 1, black correction means 2A, and black-approximated data generating means 4 are the same as in the first preferred embodiment shown in FIG. 1. This embodiment differs from the first preferred embodiment in the point that instead of the black correction means 2A, an image display means 3B and gradation transforming means 7 are added. That is, a black correction part 115 is made up of the black correction means 2A, black-approximated data generating means 4, and gradation transforming means 7.

In the foregoing first to seventh preferred embodiments, it is assumed that the image display means is an image display means 3 in which the relationship between the size of after-external-light-correction data R2, G2, B2 to be inputted, and tristimulus values X1, Y1, Z1 of color (light) to be displayed, can be expressed in the following equation (32), that is, tristimulus values X1, Y1, and Z1 vary linearly (have linear gradation characteristics), with respect to after-external-light-correction data R2, G2, and B2 to be inputted.

$$\begin{bmatrix} X1 \\ Y1 \\ Z1 \end{bmatrix} = \begin{bmatrix} axr & axg & axb \\ ayr & ayg & ayb \\ azr & azg & azb \end{bmatrix} \begin{bmatrix} R2 \\ G2 \\ B2 \end{bmatrix} + \begin{bmatrix} Xbk1 \\ Ybk1 \\ Zbk1 \end{bmatrix} \tag{32}$$

However, there are many existing image display means in which gradation characteristics is non-linear and tristimulus values X1, Y1, Z1 are non-linear to data inputted. The image display means 3B of the ninth preferred embodiment has non-linear gradation characteristics, and the relationship between after-gradation-transformation image data R8, G8, B8 to be inputted and tristimulus values X1, Y1, Z1 to be displayed can be expressed in the following equation (33):

$$\begin{bmatrix} X1 \\ Y1 \\ Z1 \end{bmatrix} = \begin{bmatrix} axr & axg & axb \\ ayr & ayg & ayb \\ azr & azg & azb \end{bmatrix} \begin{bmatrix} f(R8) \\ f(R8) \\ f(R8) \end{bmatrix} + \begin{bmatrix} Xbk1 \\ Ybk1 \\ Zbk1 \end{bmatrix} \tag{33}$$

In equation (33), f(x) is a function of x, and denotes gradation characteristics on the image display means 3B. In the image display means 3B of this preferred embodiment, f(x) is a non-linear function.

The operation of the image display device of the ninth preferred embodiment will be described by referring to FIG. 25. Image data Ri, Gi, and Bi that are composed of three color data inputted from the image display device are inputted to the input image processing means 1. The input image processing means 1 subjects the inputted image data Ri, Gi, and Bi to input image processing, then outputs after-input-processing image data R1, G1, and B1 composed of three color data. On the other hand, the black-approximated data generating means 4 holds black-approximated data R3, G3, and B3 and provides them to the black correction means 2A. The black correction means 2A inputs the after-input-processing image data R1, G1, B1, and the black-approximated data R3, G3, B3, then calculates and outputs after-black-correction data R2, G2, and B2. The foregoing processing is the same as that in the first preferred embodiment.

Since the processing of calculating the after-black-correction data R2, G2, and B2 in the black correction means 2A is the same as in the first preferred embodiment, its detailed description is omitted. The black correction means 2A can be realized with the any configuration shown in the second to sixth preferred embodiments. The after-black-correction data R2, G2, and B2 outputted from the black correction means 2A are sent to the gradation transforming means 7. In the gradation transforming means 7, gradation transformation expressed in the following equation (34) is performed to output after-gradation-transformation image data R8, G8, and B8. The gradation transforming means 7 may be configured with hardware or software.

$$R8=g(R2)=f^{-1}(R2)\quad G8=g(G2)=f^{-1}(G2)\quad B8=g(B2)=f^{-1}(B2) \tag{34}$$

In equation (34), g(x) is the inverse function of gradation characteristics f(x) of the image display means 3B, and g(f(x))=f(g(x))=1. The after-gradation transformation data R8, G8, and B8 outputted from the gradation transforming means 7 are inputted to the image display means 3B. Here, in the image display means 3B, the relationship between after-gradation-transformation image data R8, G8, B8 to be inputted and tristimulus values X1, Y1, Z1 to be displayed, can be expressed in equation (33). On the other hand, after-black-correction data R2, G2, B2, and after-gradation-transformation image data R8, G8, B8, can be expressed in equation (34). Therefore, the relationship between the after-black-correction data R2, G2, B2 and the tristimulus values X1, Y1, Z1 to be displayed on the image display means 3B can be expressed in the following equation (35):

$$\begin{bmatrix} X1 \\ Y1 \\ Z1 \end{bmatrix} = \begin{bmatrix} axr & axg & axb \\ ayr & ayg & ayb \\ azr & azg & azb \end{bmatrix} \begin{bmatrix} R2 \\ G2 \\ B2 \end{bmatrix} + \begin{bmatrix} Xbk1 \\ Ybk1 \\ Zbk1 \end{bmatrix} \tag{35}$$

From equation (35), the tristimulus values X1, Y1, and Z1 to be displayed on the image display means 3B are linear to the after-black-correction data R2, G2, and B2. Accordingly, the processing corresponding to the black correction means 2 can be the same as in the foregoing first to seventh preferred embodiments.

Since the image display device of the ninth preferred embodiment subjects after-black-correction data to gradation transformation expressed in the inverse function of the gradation characteristics of the image display means, the equivalent display to that in a situation where there is no influence of external light is obtainable with respect to a large amount of data, even when the gradation characteristics of the image display means is non-linear and there is the influence of external light. This makes possible to provide image having a large contrast and excellent visibility to the viewer.

Further in the ninth preferred embodiment, by setting black-approximated data by applying the concept of the second preferred embodiment, the equivalent display to that in a situation where the tristimulus values in displaying black are zero, is obtainable even when the tristimulus values in displaying black have large values due to the characteristics of the image display means, in addition to the influence of external light.

10. Tenth Preferred Embodiment

Figure 26:
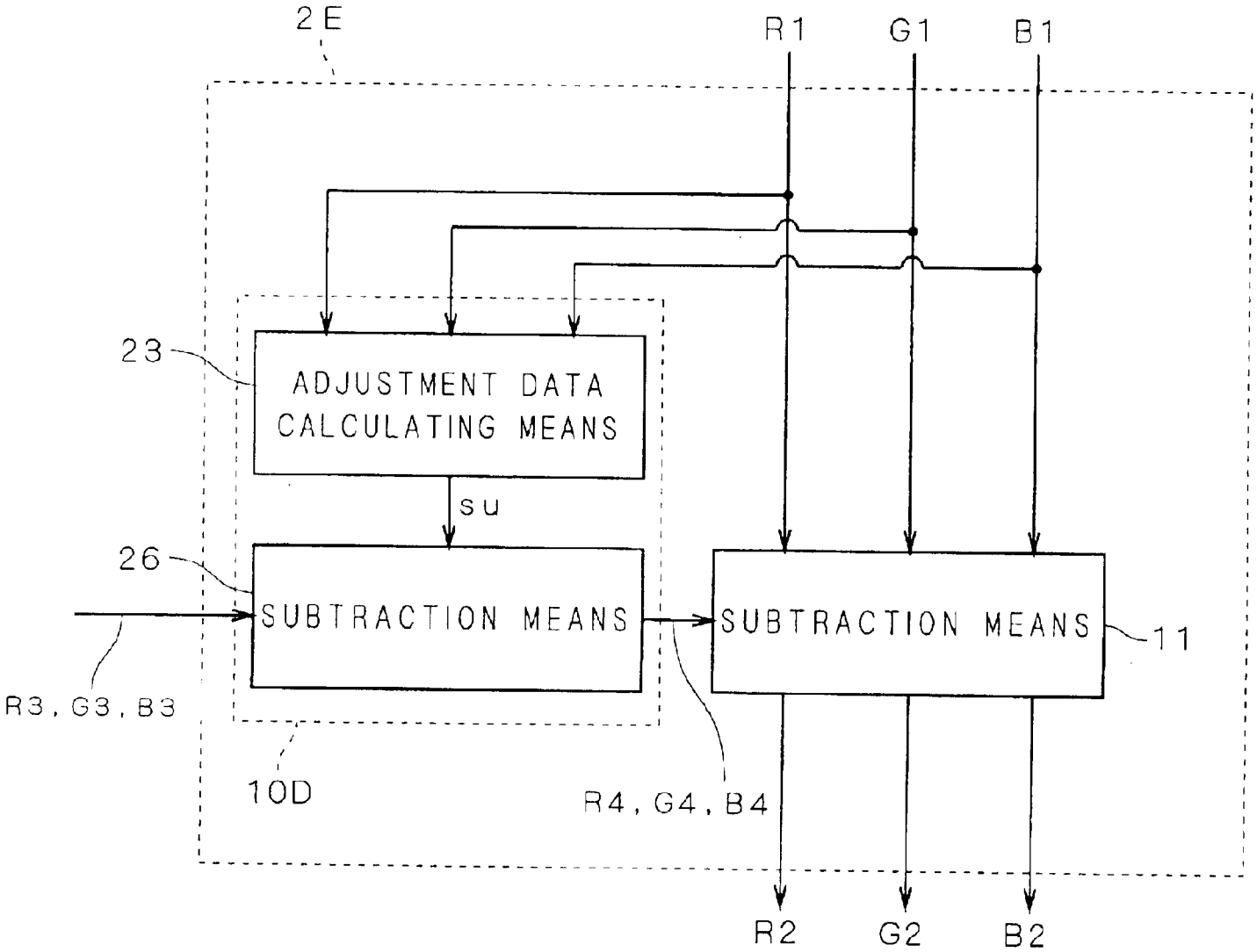
FIG. 26 is a block diagram showing an example of the configuration of a black correction means in an image display device according to a tenth preferred embodiment of the invention.

FIG. 26 is a block diagram showing an example of the configuration of a black correction means in an image display device according to a tenth preferred embodiment of the invention. As shown in FIG. 26, a black correction means 2E is configured with a subtraction data calculating means 10D (adjustment data calculating means 23, and subtraction means 26), and subtraction means 11. In FIG. 26, the subtraction means 11 is the same as in the fourth preferred embodiment shown in FIG. 15, and the overall configuration is the same as in the first preferred embodiment, except that the black correction means 2A is replaced with the black correction means 2E. The black correction means 2E can be realized with any configuration shown in the second to sixth preferred embodiments.

As in the case with the fourth preferred embodiment, black-approximated data R3, G3, and B3 inputted to the black correction means 2E are inputted to the subtraction data calculating means 10D, and subtraction data R4, G4, and B4 are calculated in the subtraction data calculating means 10D. The subtraction data calculating means 10D is configured with the adjustment data calculating means 23 and subtraction means 26.

The adjustment data calculating means 23 inputs after-input-processing image data R1, G1, and B1, then calculates adjustment data su, based on the image data R1, G1, and B1.

The subtraction means 26 inputs the adjustment data su outputted from the adjustment data calculating means 23, and the black-approximated data R3, G3, and B3, then calculates subtraction data R4, G4, and B4 by subtraction processing expressed in the following equation (36):

$$R4=R3-su\ G4=G3-su\ B4=B3-su \tag{36}$$

The subtraction means 11 inputs the after-input-processing data R1, G1, B1, and the subtraction data R4, G4, B4, then calculates and outputs after-black-correction data R2, G2, B2 by subtraction processing expressed in the following equation (37):

$$R2=R1-R4G2=G1-G4B2=B1-B4 \tag{37}$$

Figure 27:
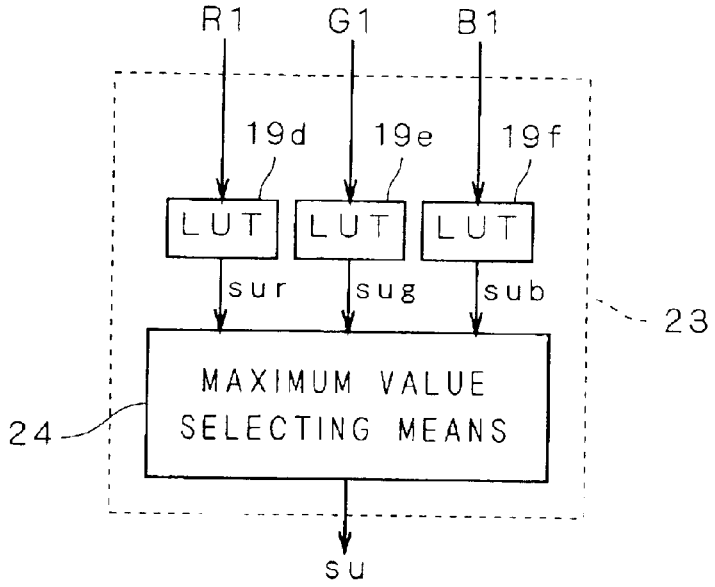
FIG. 27 is a block diagram showing an example of the configuration of an adjustment data calculating means.

FIG. 27 is a block diagram showing an example of the configuration of the adjustment data calculating means 23. As shown in FIG. 27, it is configured with look-up tables 19*d* to 19*f*, and maximum value selecting means 24.

The after-input-processing image data R1, G1, and B1 are inputted to the look-up tables 19*d*, 19*e*, and 19*f*. The look-up tables 19*d*, 19*e*, and 19*f* output adjustment data sur, sug, and sub that correspond to the after-input-processing image data R1, G1, and B1, respectively.

The maximum value selecting means 24 outputs, as an adjustment data su, the adjustment data having the maximum value in the adjustment data sur, sug, and sub outputted from the look-up tables 19*d*, 19*e*, and 19*f*.

Following is one example of the adjustment data sur, sug, and sub to be stored in the look-up tables 19*d*, 19*e*, and 19*f*. In the image display device of the tenth preferred embodiment, the after-black-correction data R2, G2, and B2 are calculated by subtracting the subtraction data R4, G4, and B4 from the after-input-processing image data R1, G1, and B1 in the subtraction means 11, as stated above. Theoretically, subtraction data R4, G4, and B4 should be equal to black-approximated data R3, G3, and B3, respectively. However, the black-approximated data R3, G3, and B3 are data related to the luminance, chromaticity, or tristimulus values in displaying black on the image display means 3, and will not vary depending on the values of the after-input-processing image data R1, G1, and B1 . Therefore, if the subtraction data R4, G4, and B4 are equal to the black-approximated data R3, G3, and B3, a negative value occurs in the after-black-correction data when the values of the after-input-processing image data R1, G1, and B1 are smaller than the values of the black-approximated data R3, G3, and B3.

Because of this, the look-up tables 19*d* to 19*f* generate adjustment data sur, sug, and sub, each having a positive value, when the values of after-input-processing image data R1, G1, and B1 are small. The subtraction data calculating means 10 calculates subtraction data R4, G4, and B4 by subjecting the black-approximated data R3, G3, and B3 to subtraction processing using adjustment data su. This reliably prevents that any negative value occurs in the after-black-correction data R2, G2, and B2.

Figure 28:
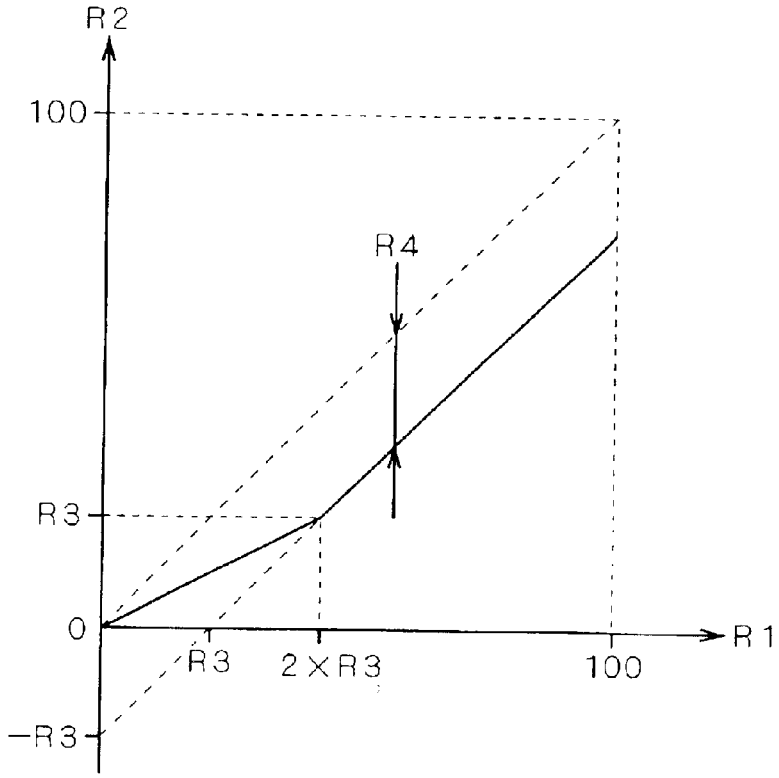
FIG. 28 is a graph showing an example of the relationship between after-input-processing image data and after-black-correction data.
Figure 29:
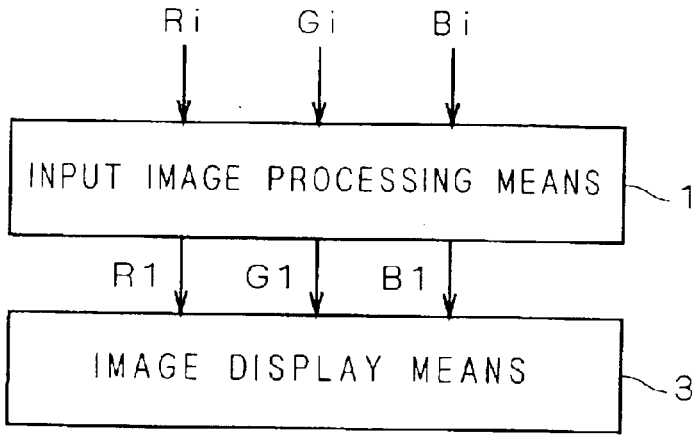
FIG. 29 is a block diagram showing an example of the configuration of a conventional image display device.

FIG. 28 is a graph showing an example of the relationship between after-input-processing image data and after-black-correction data. Consider the instance of storing, in the look-up table 19*d*, adjustment data sur with which after-input-processing image data R1 and after-black-correction data R2 are in such a relationship as shown in FIG. 28. Here, the after-black-correction image data R2 can be expressed in the following equation (38):

$$R2 = R1 - R3 \quad \text{when } R1 \geq 2 \cdot R3 \tag{38}$$

$$R2 = \frac{R1}{2} \quad \text{when } R1 < 2 \cdot R3$$

Since subtraction data R4 is a difference between the after-black-correction data R2 and after-input-processing image data R1, it can be expressed in the following equation (39):

$$R4 = R3 \quad \text{when } R1 \geq 2 \cdot R3 \tag{39}$$

$$R4 = \frac{R1}{2} \quad \text{when } R1 < 2 \cdot R3$$

Further, since the adjustment data sur is a difference between black-approximated data R3 and subtraction data R4, it can be found from the following equation (40). Note that the value of black-approximated data R3 in equation (40) may be previously written to the look-up table 19*d* by using a table data writing means etc. (not shown). Although the above discussion is directed to sur, the same is true for sug and sub.

$$sur = 0 \quad \text{when } R1 \geq 2 \cdot R3 \tag{40}$$

$$sur = R3 - \frac{R1}{2} \quad \text{when } R1 < 2 \cdot R3$$

Since the adjustment data calculating means 23 of the tenth preferred embodiment outputs the maximum value in the adjustment data sur, sug, and sub, as adjustment data su, it is therefore possible to prevent that any negative value occurs in the after-black-correction data R2, G2, and B2. Thus, with the image display device of the tenth preferred embodiment, the equivalent display to that in a situation where there is no influence of external light is obtainable with respect to a large amount of data, even when there is the influence of external light. This makes possible to provide image having a large contrast and excellent visibility to the viewer.

In the first preferred embodiment, there occurs "black fading" phenomenon that luminance is constant in the region where after-input-processing image data R1, G1, and B1 are not more than black-approximated data R3, G3, and B3. Whereas in the image display device of the tenth preferred embodiment, "black fading" can be suppressed by allowing the look-up tables to store suitable adjustment data.

While the invention has been shown and described in detail, the foregoing description is in all aspects illustrative and not restrictive. It is therefore understood that numerous modifications and variations that are not shown can be devised without departing from the scope of the invention.

What is claimed is:

1. An image display device comprising:

a black correction part performing a black correction processing for correcting black reproducibility on an image data containing a color data to output an after-black-correction image data; and an image display means performing an image display on a predetermined screen based on said after-black-correction image data, said black correction part performing said black correction processing based on characteristics of said image display means when displaying black;

wherein said color data contains a predetermined number of color data, and said black correction part includes:

a black-approximated data generating means generating a black-approximated data that is data related to at least one of luminance, chromaticity and tristimulus values when said image display means displays black based on said characteristics of said image display means when displaying black; and a black correction means performing subtraction processing on said image data based on said black-approximated data in units of said predetermined number of color data, to output said after-black-correction image data.

2. The image display device according to claim 1, wherein said black correction means includes:

a subtraction means said black-approximated data from said image data in units of said predetermined number of color data, to obtain after-subtraction data; and a limiter setting a color data of less than "0" among said predetermined number of color data in said after-subtraction data, to "0", thereby to obtain said after-black-correction image data.

3. The image display device according to claim 1, wherein said black correction means includes:

a subtraction means subtracting said black-approximated data from said image data in units of said predetermined number of color data, to obtain after-subtraction data;

an addition data generating means generating addition data of not less than "0" based on said after-subtraction data; and an addition means adding said addition data to said after-subtraction data in units of said predetermined number of color data, to obtain said after-black-correction image data.

4. The image display device according to claim 1, wherein said black correction means includes:

a subtraction data calculating means multiplying said black-approximated data by a multiplication factor of not more than "1" based on said image data, to obtain subtraction data; and a subtraction means obtaining subtraction data by subtracting said subtraction data from said image data in units of said predetermined number of color data, and outputting said subtraction data as said after-black-correction image data.

5. The image display device according to claim 4, wherein said subtraction data calculating means includes:

a multiplication factor calculating means calculating a multiplication factor of not more than "1", based on said image data; and a multiplication means multiplying said black-approximated data by said multiplication factor, to obtain subtraction data, said multiplication factor calculating means includes:

a multiplication factor candidate outputting part outputting a predetermined number of multiplication factor candidates corresponding to said predetermined number of color data based on said image data; and a minimum value selecting means selecting a minimum multiplication factor candidate from said predetermined number of multiplication factor candidates and outputting said minimum multiplication factor candidate as said multiplication factor.

6. The image display device according to claim 1, wherein said black correction means includes:

a subtraction data calculating means subtracting adjustment data of not less than "0" based on said image data from said black-approximated data, to obtain subtraction data; and a subtraction means subtracting said subtraction data from said image data in units of said predetermined number of color data, to obtain subtraction data, and outputting said subtraction data as said after-black-correction image data.

7. An image display device comprising:

a black correction part performing a black correction processing for correcting black reproducibility on an image data containing a color data to output an after-black-correction image data; and an image display means performing an image display on a predetermined screen based on said after-black-correction image data, said black correction part performing said black correction processing based on characteristics of said image display means when displaying black;

wherein said color data contains a predetermined number of color data, and said black correction part includes:

a black-approximated data generating means generating a black-approximated data that is data related to at least one of luminance, chromaticity and tristimulus values when said image display means displays black based on said characteristics of said image display means when displaying black;

a look-up table storing a table data; and a table data writing means writing, in a look-up table, a table data capable of deriving one of said after-black-correction image data from said black-approximated data and said image data, said look-up table obtaining said after-black-correction image data based on said image data by referring to said table data.

8. An image display device comprising:

a black correction part performing a black correction processing for correcting black reproducibility on an image data containing a color data to output an after-black-correction image data; and an image display means performing an image display on a predetermined screen based on said after-black-correction image data.

said black correction part performing said black correction processing based on characteristics of said image display means when displaying black;

wherein said color data contains a predetermined number of color data, and said black correction part includes:

a black-approximated data generating means generating a black-approximated data that is data related to at least one of luminance, chromaticity and tristimulus values when said image display means displays black based on said characteristics of said image display means when displaying black;

a black correction means subtracting said after-black-correction image data from said image data in units of said predetermined number of color data, to output said after-black-correction image data; and a gradation transforming means performing gradation transformation on said after-black-correction image data to output after-gradation correction image data, said image display means includes an image display means performing image display on said predetermined screen based on said after-gradation-correction image data, and said gradation transformating means obtains said after-gradation-correction image data such that at least one of luminance, chromaticity and tristimulus values of color displayed on said image display means is linear to said after-black-correction data.

9. An image display device comprising:

a black correction part performing a black correction processing for correcting black reproducibility on an image data containing a color data to output an after-black-correction image data; and an image display means performing an image display on a predetermined screen based on said after-black-correction image data, said black correction part performing said black correction processing based on characteristics of said image display means when displaying black;

wherein said color data contains a predetermined number of color data, and said black correction part includes:

an external light detecting means detecting at least one of luminance, chromaticity and tristimulus values of external light irradiating the surface of said predetermined screen of said image display means, to output an external light detection data; and a black-approximated data calculating and generating means calculating and generating a black-approximated data related to said characteristic of said image display means when displaying black based on said external data detection data.

10. An image display device comprising:

a black correction part performing a black correction processing for correcting black reproducibility on an image data containing a color data to output an after-black-correction image data; and an image display means performing an image display on a predetermined screen based on said after-black-correction image data, said black correction part performing said black correction processing based on characteristics of said image display means when displaying black;

wherein said characteristics of said image display means when displaying black contains characteristics of a reflected light of external light on the surface of said predetermined screen of said image display means.

11. The image display device according to claim 10, wherein said characteristics of said reflected light of external light contains at least one of luminance, chromaticity and tristimulus values of color in said reflected light of external light.

12. The image display device according to claim 11, wherein said black-approximated data contains a black-approximated data of which value is set such that a difference between an image index value that is data of at least one of luminance, chromaticity and tristimulus values of color displayed when said black-approximated data is inputted to said image display means in a situation where there is no influence of external light, and said image index value when said image display means displays black, is said image index value in said reflected light of external light.

13. The image display device according to claim 11, wherein said characteristics of said image display means when displaying black further contains at least one of luminance, chromaticity and tristimulus values of color when said image display means displays black.

14. The image display device according to claim 13, wherein said black-approximated data contains a black-approximated data of which value is set such that a difference between an image index value that is data of at least one of luminance, chromaticity and tristimulus values of color displayed when said black-approximated data is inputted to said image display means in a situation where there is no influence of external light, and said image index value when said image display means displays black, is said image index value of color when said image display means displays black in a situation where there is the influence of external light.

15. An image display device comprising:

a black correction part performing a black correction processing for correcting black reproducibility on an image data containing a color data to output an after-black-correction image data; and an image display means performing an image display on a predetermined screen based on said after-black-correction image data, said black correction part performing said black correction processing based on characteristics of said image display means when displaying black;

wherein said characteristics of said image display means when displaying black contains at least one of luminance, chromaticity and tristimulus values of color when said image display means displays black in a situation where there is no influence of external light.

* * * * *